US009269347B2

(12) United States Patent
Latorre-Martinez et al.

(10) Patent No.: US 9,269,347 B2
(45) Date of Patent: Feb. 23, 2016

(54) TEXT TO SPEECH SYSTEM

(71) Applicant: Kabushiki Kaisha Toshiba, Tokyo (JP)

(72) Inventors: Javier Latorre-Martinez, Cambridge (GB); Vincent Ping Leung Wan, Cambridge (GB); Kean Kheong Chin, Cambridge (GB); Mark John Francis Gales, Cambridge (GB); Katherine Mary Knill, Cambridge (GB); Masami Akamine, Cambridge (GB)

(73) Assignee: Kabushiki Kaisha Toshiba, Tokyo (JP)

( * ) Notice: Subject to any disclaimer, the term of this patent is extended or adjusted under 35 U.S.C. 154(b) by 67 days.

(21) Appl. No.: 13/836,146

(22) Filed: Mar. 15, 2013

(65) Prior Publication Data

US 2013/0262119 A1 Oct. 3, 2013

(30) Foreign Application Priority Data

Mar. 30, 2012 (GB) ..... 1205791.5

(51) Int. Cl.

| | |
|---|---|
| ***G10L 13/00*** | (2006.01) |
| ***G10L 13/08*** | (2013.01) |
| ***G10L 13/033*** | (2013.01) |
| *G10L 21/013* | (2013.01) |

(52) U.S. Cl.

CPC ..... *G10L 13/08* (2013.01); *G10L 13/033* (2013.01); *G10L 2021/0135* (2013.01)

(58) Field of Classification Search

CPC ..... G10L 13/02; G10L 13/08

See application file for complete search history.

(56) References Cited

U.S. PATENT DOCUMENTS

| | | | | |
|---|---|---|---|---|
| 6,810,378 | B2 * | 10/2004 | Kochanski et al. | 704/258 |
| 7,454,348 | B1 | 11/2008 | Kapilow et al. | |
| 8,175,879 | B2 * | 5/2012 | Nitisaroj et al. | 704/260 |
| 8,694,320 | B2 * | 4/2014 | Kirkeby | 704/260 |
| 2003/0028380 | A1 * | 2/2003 | Freeland et al. | 704/260 |

(Continued)

FOREIGN PATENT DOCUMENTS

| | | |
|---|---|---|
| EP | 1 071 073 A2 | 1/2001 |
| EP | 1 071 073 A3 | 1/2001 |

(Continued)

OTHER PUBLICATIONS

The Extended European Search Report issued Sep. 12, 2013, in Application No. / Patent No. 13159582.9-1910.

(Continued)

*Primary Examiner* — Daniel Abebe

(74) *Attorney, Agent, or Firm* — Oblon, McClelland, Maier & Neustadt, L.L.P.

(57) ABSTRACT

A text-to-speech method configured to output speech having a selected speaker voice and a selected speaker attribute, including: inputting text; dividing the inputted text into a sequence of acoustic units; selecting a speaker for the inputted text; selecting a speaker attribute for the inputted text; converting the sequence of acoustic units to a sequence of speech vectors using an acoustic model; and outputting the sequence of speech vectors as audio with the selected speaker voice and a selected speaker attribute. The acoustic model includes a first set of parameters relating to speaker voice and a second set of parameters relating to speaker attributes, which parameters do not overlap. The selecting a speaker voice includes selecting parameters from the first set of parameters and the selecting the speaker attribute includes selecting the parameters from the second set of parameters.

23 Claims, 12 Drawing Sheets

(56) References Cited

U.S. PATENT DOCUMENTS

| | | | | |
|---|---|---|---|---|
| 2005/0182630 | A1 | 8/2005 | Miro et al. | |
| 2006/0069567 | A1 | 3/2006 | Tischer et al. | |
| 2009/0287469 | A1 | 11/2009 | Matsukawa et al. | |
| 2009/0326948 | A1* | 12/2009 | Agarwal et al. | 704/260 |
| 2011/0106524 | A1 | 5/2011 | Mousaad | |
| 2012/0173241 | A1 | 7/2012 | Li et al. | |
| 2012/0278081 | A1* | 11/2012 | Chun et al. | 704/260 |

FOREIGN PATENT DOCUMENTS

| | | | |
|---|---|---|---|
| EP | 1 345 207 | A1 | 9/2003 |
| JP | 2006-285115 | | 10/2006 |
| JP | 2011-28130 | A | 2/2011 |
| JP | 2012-529664 | A | 11/2012 |
| WO | WO 2010/142928 | A1 | 12/2010 |

OTHER PUBLICATIONS

U.S. Appl. No. 14/458,556, filed Aug. 13, 2014, Kolluru, et al.

Great Britain Search Report issued Jul. 30, 2012, in Patent Application No. GB1205791.5, filed Mar. 30, 2012.

Combined Chinese Office Action and Search Report issued Mar. 25, 2015 in Patent Application No. 201310110148.6 (with English language translation).

Masatsune Tamura, et al., "Speaker Adaption for HMM-Based Speech Synthesis System Using MLLR" The Third ESCA/COCOSDA Workshop (ETRW) on Speech Synthesis, 1998, 5 pages.

Takashi Nose, et al., "A Perceptual Expressivity Modeling Technique for Speech Synthesis based on Multiple-Regression HSMM" Interspeech 2011, Aug. 28-31, 2011, pp. 109-112.

Junichi Yamagishi, et al., "Acoustic Modeling of Speaking Styles and Emotional Expressions in HMM-Based Speech Synthesis" IEICE Trans. Inf. & Syst., vol. E88-D, No. 3, Mar. 2005, pp. 502-509.

Office Action issued Feb. 4, 2014 in Japanese Patent Application No. 2013-056399 (with English language translation).

Hiroki Kanagawa, et al. "A study on speaker-independent style conversion in HMM speech synthesis", The Institute of Electronics, Information and Communication Engineers Technical Report, vol. 111, No. 364, Dec. 2011, pp. 191-196 (with cover page and English abstract).

Decision to Decline the Amendment issued Jan. 27, 2015, in Japanese Patent Application No. 2013-056399 (in English).

Zen et al., "Statistical Parametric Speech Synthesis Based on Speaker and Language Factorization", IEEE Transactions on Audio, Speech, and Language Processing, vol. 20, No. 6, 20120207, pp. 1713-1724, IEEE.

* cited by examiner

TEXT TO SPEECH SYSTEM

FIELD

Embodiments of the present invention as generally described herein relate to a text-to-speech system and method.

BACKGROUND

Text to speech systems are systems where audio speech or audio speech files are outputted in response to reception of a text file.

Text to speech systems are used in a wide variety of applications such as electronic games, E-book readers, E-mail readers, satellite navigation, automated telephone systems, automated warning systems.

There is a continuing need to make systems sound more like a human voice.

BRIEF DESCRIPTION OF THE FIGURES

Systems and Methods in accordance with non-limiting embodiments will now be described with reference to the accompanying figures in which.

DETAILED DESCRIPTION

Figure 1:
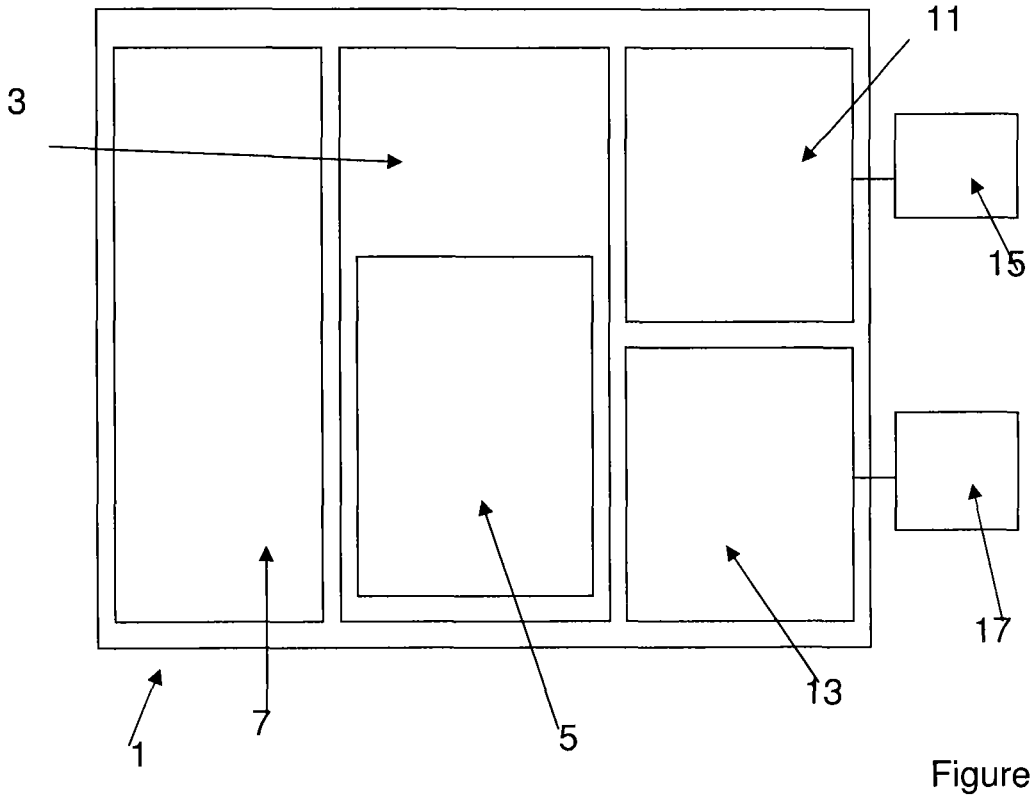
FIG. 1 is schematic of a text to speech system.

In an embodiment, a text-to-speech method configured to output speech having a selected speaker voice and a selected speaker attribute is provided, said method comprising:

inputting text;

dividing said inputted text into a sequence of acoustic units;

selecting a speaker for the inputted text;

selecting a speaker attribute for the inputted text;

converting said sequence of acoustic units to a sequence of speech vectors using an acoustic model; and outputting said sequence of speech vectors as audio with said selected speaker voice and a selected speaker attribute, wherein said acoustic model comprises a first set of parameters relating to speaker voice and a second set of parameters relating to speaker attributes, wherein the first and second set of parameters do not overlap, and wherein selecting a speaker voice comprises selecting parameters from the first set of parameters which give the speaker voice and selecting the speaker attribute comprises selecting the parameters from the second set which give the selected speaker attribute.

The above method uses factorisation of the speaker voice and the attributes. The first set of parameters can be considered as providing a "speaker model" and the second set of parameters as providing an "attribute model". There is no overlap between the two sets of parameters so they can each be varied independently such that an attribute may be combined with a range of different speakers.

Methods in accordance with some of the embodiments synthesis speech with a plurality of speaker voices and of expressions and/or any other kind of voice characteristic, such as speaking style, accent, etc.

The sets of parameters may be continuous such that the speaker voice is variable over a continuous range and the voice attribute is variable over a continuous range. Continuous control allows not just expressions such as "sad" or "angry" but also any intermediate expression. The values of the first and second sets of parameters may be defined using audio, text, an external agent or any combination thereof.

Possible attributes are related to emotion, speaking style or accent.

In one embodiment, there are a plurality of independent attribute models, for example emotion and attribute so that it is possible to combine the speaker model with a first attribute model which models emotion and a second attribute model which models accent. Here, there can be a plurality of sets of parameters relating to different speaker attributes and the plurality of sets of parameters do not overlap.

In a further embodiment, the acoustic model comprises probability distribution functions which relate the acoustic units to the sequence of speech vectors and selection of the first and second set of parameters modifies the said probability distributions. Generally, these probability density functions will be referred to as Gaussians and will be described by a mean and a variance. However, other probability distribution functions are possible.

In a further embodiment, control of the speaker voice and attributes is achieved via a weighted sum of the means of the said probability distributions and selection of the first and second sets of parameters controls the weights and offsets used. For example:

$$\mu_{xpr}^{spkrModel} = \sum_{\forall i} \lambda_i^{spkr} \mu_i^{skprModel} + \sum_{\forall k} \lambda_k^{xpr} \mu_k^{xprModel}$$

Where $\mu_{xpr}^{spkrModel}$ is the mean of the probability distribution for the speaker model combined with expression xpr, $\mu^{spkrModel}$ is the mean for the speaker model in the absence of expression, $\mu^{xprModel}$ is the mean for the expression model independent of speaker, $\lambda^{spkr}$ the speaker dependent weighting and $\lambda^{xpr}$ is the expression dependent weighting.

The control of the output speech can be achieved by means of weighted means, in such a way that each voice characteristic is controlled by an independent sets of means and weights.

The above may be achieved using a cluster adaptive training (CAT) type approach where the first set of parameters and the second set of parameters are provided in clusters, and each cluster comprises at least one sub-cluster, and a weighting is derived for each sub-cluster.

In an embodiment, said second parameter set is related to an offset which is added to at least some of the parameters of the first set of parameters, for example as:

$$\mu_{xpr}^{spkrModel}=\mu_{neu}^{spkrModel}+\Delta_{xpr}$$

Where $\mu_{neu}^{spkrModel}$ is the speaker model for neutral emotion and $\Delta_{xpr}$ is the offset. In this specific example the offset is to be applied to the speaker model for neutral emotion, but it can also be applied to the speaker model for different emotions depending on whether the offset was calculated with respect to a neutral emotion or another emotion.

The offset $\Delta$ here can be thought of as a weighted mean when a cluster based method is used. However, other methods are possible as explained later.

This will allow exporting of the voice characteristics of one statistical model to a target statistical model by adding to the means of the target model an offset vector that models one or more the desired voice characteristics Some methods in accordance with embodiments of the present invention allow a speech attribute to be transplanted from one speaker to another. For example, from a first speaker to a second speaker, by adding second parameters obtained from the speech of a first speaker to that of a second speaker.

In one embodiment, this may be achieved by:

receiving speech data from the first speaker speaking with the attribute to be transplanted;

identifying speech data for the first speaker which is closest to the speech data of the second speaker;

determining the difference between the speech data obtained from the first speaker speaking with the attribute to be transplanted and the speech data of the first speaker which is closest to the speech data of the second speaker; and determining the second parameters from the said difference, for example, second parameters may be related to the difference by a function $f$:

$$\Delta_{xpr}=\theta(\mu_{xpr}^{xprModel}-\hat{\mu}_{neu}^{xprModel})$$

Here, $\mu_{xpr}^{xprModel}$ is the mean for the expression model of a given speaker, speaking with the attribute xpr to be transplanted and $\hat{\mu}_{neu}^{xprModel}$ is the mean vector of the model for the given speaker which best matches that of the speaker to which the attribute is to be applied. In this example, the best match is shown for neutral emotion data, but it could be for any other attribute which is common or similar for the two speakers.

The difference may be determined from a difference between the mean vectors of the probability distributions which relate the acoustic units to the sequence of speech vectors.

It should be noted that the "first speaker" model can also be a synthetic such as an average voice model built from the combination of data from multiple speakers.

In a further embodiment, the second parameters are determined as a function of the said difference and said function is a linear function, for example:

$$\Delta_{xpr}=A_{spkr}^{xprModel}(\mu_{xpr}^{xprModel}-\hat{\mu}_{neu}^{xprModel})+b_{spkr}^{xprModel}$$

Where A and b are parameters. The parameters to control said function (for example A and b) and/or the mean vector of the most similar expression to that of the speaker model may be computed automatically from the parameters of the expression model set and one or more of:

the parameters of the probability distributions of the speaker dependent model or the data used to train such speaker dependent model;

information about the voice characteristics of the speaker dependent model

Identifying speech data for the first speaker which is closest to the speech data of the second speaker may comprise minimizing a distance function that depends on the probability distributions of the speech data of the first speaker and the speech data of the second speaker, for example using the expression:

$$\hat{\mu}_{neu}^{xprModel}=\min_{\mu_y^{xprModel}} f(\mu_{neu}^{spkrModel}, \Sigma_{neu}^{spkrModel}, \mu_y^{xprModel}, \Sigma_y^{xprModel})$$

Where $\mu_{neu}^{SpkrModel}$ and $\Sigma_{neu}^{SpkrModel}$ are the mean and variance for the speaker model and $\mu_y^{xprModel}$ and $\Sigma_y^{xprModel}$ are the mean and variance for the emotion model.

The distance function may be a euclidean distance, Bhattacharyya distance or Kullback-Leibler distance.

In a further embodiment, a method of training an acoustic model for a text-to-speech system is provided, wherein said acoustic model converts a sequence of acoustic units to a sequence of speech vectors, the method comprising:

receiving speech data from a plurality of speakers and a plurality of speakers speaking with different attributes;

isolating speech data from the received speech data which relates to speakers speaking with a common attribute;

training a first acoustic sub-model using the speech data received from a plurality of speakers speaking with a common attribute, said training comprising deriving a first set of parameters, wherein said first set of parameters are varied to allow the acoustic model to accommodate speech for the plurality of speakers;

training a second acoustic sub-model from the remaining speech, said training comprising identifying a plurality of attributes from said remaining speech and deriving a set of second parameters wherein said set of second parameters are varied to allow the acoustic model to accommodate speech for the plurality of attributes; and outputting an acoustic model by combining the first and second acoustic sub-models such that the combined acoustic model comprises a first set of parameters relating to speaker voice and a second set of parameters relating to speaker attributes, wherein the first and second set of parameters do not overlap, and wherein selecting a speaker voice comprises selecting parameters from the first set of parameters which give the speaker voice and selecting the speaker attribute comprises selecting the parameters from the second set which give the selected speaker attribute.

For example, the common attribute may be a subset of the speakers speaking with neutral emotion, or all speaking with the same emotion, same accent etc. It is not necessary for all speakers to be recorded for all attributes. It is also possible, (as explained above in relation to transplanting an attribute) for the system to be trained in relation to one attribute where the only speech data of this attribute is obtained from one speaker who is not one of the speakers used to train the first model.

The grouping of the training data may be unique for each voice characteristic.

In a further embodiment, the acoustic model comprises probability distribution functions which relate the acoustic units to the sequence of speech vectors, and training the first acoustic sub-model comprises arranging the probability distributions into clusters, with each cluster comprises at least one sub-cluster, and wherein said first parameters are speaker dependent weights to be applied such there is one weight per sub-cluster, and training the second acoustic sub-model comprises arranging the probability distributions into clusters, with each cluster comprises at least one sub-cluster, and wherein said second parameters are attribute dependent weights to be applied such there is one weight per sub-cluster.

In an embodiment, the training takes place via an iterative process wherein the method comprises repeatedly re-estimating the parameters of the first acoustic model while keeping part of the parameters of the second acoustic sub-model fixed and then re-estimating the parameters of the second acoustic sub-model while keeping part of the parameters of the first acoustic sub-model fixed until a convergence criteria is met. The convergence criteria may be replaced by the re-estimation being performed a fixed number of times, In further embodiments, a text-to-speech system is provided for use for simulating speech having a selected speaker voice and a selected speaker attribute a plurality of different voice characteristics, said system comprising:

a text input for receiving inputted text;

a processor configured to:

divide said inputted text into a sequence of acoustic units;

allow selection of a speaker for the inputted text;

allow selection of a speaker attribute for the inputted text;

convert said sequence of acoustic units to a sequence of speech vectors using an acoustic model, wherein said model has a plurality of model parameters describing probability distributions which relate an acoustic unit to a speech vector; and output said sequence of speech vectors as audio with said selected speaker voice and a selected speaker attribute, wherein said acoustic model comprises a first set of parameters relating to speaker voice and a second set of parameters relating to speaker attributes, wherein the first and second set of parameters do not overlap, and wherein selecting a speaker voice comprises selecting parameters from the first set of parameters which give the speaker voice and selecting the speaker attribute comprises selecting the parameters from the second set which give the selected speaker attribute.

Methods in accordance with embodiments of the present invention can be implemented either in hardware or on software in a general purpose computer. Further methods in accordance with embodiments of the present can be implemented in a combination of hardware and software. Methods in accordance with embodiments of the present invention can also be implemented by a single processing apparatus or a distributed network of processing apparatuses.

Since some methods in accordance with embodiments can be implemented by software, some embodiments encompass computer code provided to a general purpose computer on any suitable carrier medium. The carrier medium can comprise any storage medium such as a floppy disk, a CD ROM, a magnetic device or a programmable memory device, or any transient medium such as any signal e.g. an electrical, optical or microwave signal.

FIG. 1 shows a text to speech system 1. The text to speech system 1 comprises a processor 3 which executes a program 5. Text to speech system 1 further comprises storage 7. The storage 7 stores data which is used by program 5 to convert text to speech. The text to speech system 1 further comprises an input module 11 and an output module 13. The input module 11 is connected to a text input 15. Text input 15 receives text. The text input 15 may be for example a keyboard. Alternatively, text input 15 may be a means for receiving text data from an external storage medium or a network.

Connected to the output module 13 is output for audio 17. The audio output 17 is used for outputting a speech signal converted from text which is input into text input 15. The audio output 17 may be for example a direct audio output e.g. a speaker or an output for an audio data file which may be sent to a storage medium, networked etc.

In use, the text to speech system 1 receives text through text input 15. The program 5 executed on processor 3 converts the text into speech data using data stored in the storage 7. The speech is output via the output module 13 to audio output 17.

Figure 2:
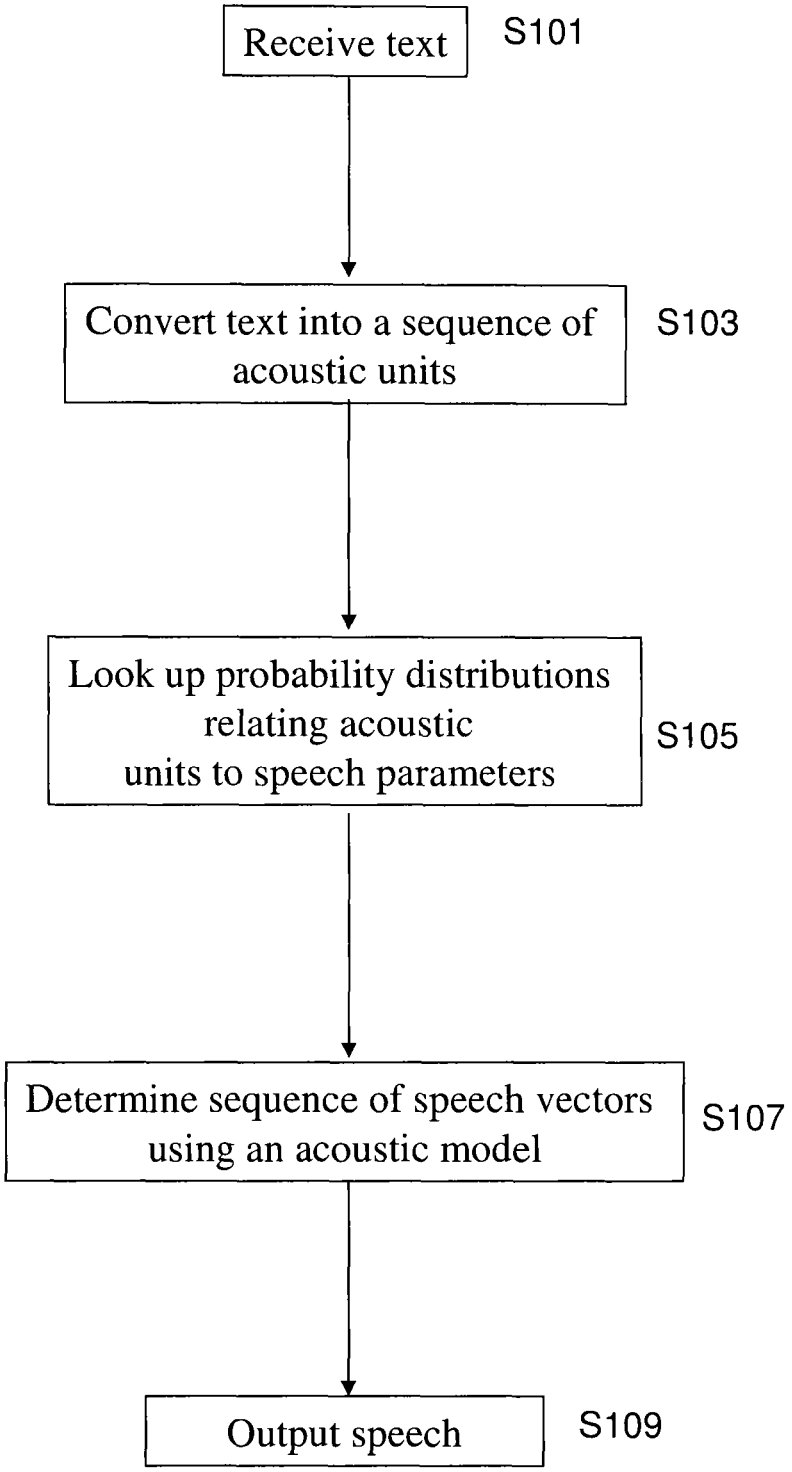
FIG. 2 is a flow diagram showing the steps performed by a speech processing system.

A simplified process will now be described with reference to FIG. 2. In first step, S101, text is inputted. The text may be inputted via a keyboard, touch screen, text predictor or the like. The text is then converted into a sequence of acoustic units. These acoustic units may be phonemes or graphemes. The units may be context dependent e.g. triphones which take into account not only the phoneme which has been selected but the proceeding and following phonemes. The text is converted into the sequence of acoustic units using techniques which are well-known in the art and will not be explained further here.

Instead S105, the probability distributions are looked up which relate acoustic units to speech parameters. In this embodiment, the probability distributions will be Gaussian distributions which are defined by means and variances. Although it is possible to use other distributions such as the Poisson, Student-t, Laplacian or Gamma distributions some of which are defined by variables other than the mean and variance.

It is impossible for each acoustic unit to have a definitive one-to-one correspondence to a speech vector or "observation" to use the terminology of the art. Many acoustic units are pronounced in a similar manner, are affected by surrounding acoustic units, their location in a word or sentence, or are pronounced differently by different speakers. Thus, each acoustic unit only has a probability of being related to a speech vector and text-to-speech systems calculate many probabilities and choose the most likely sequence of observations given a sequence of acoustic units.

Figure 3:
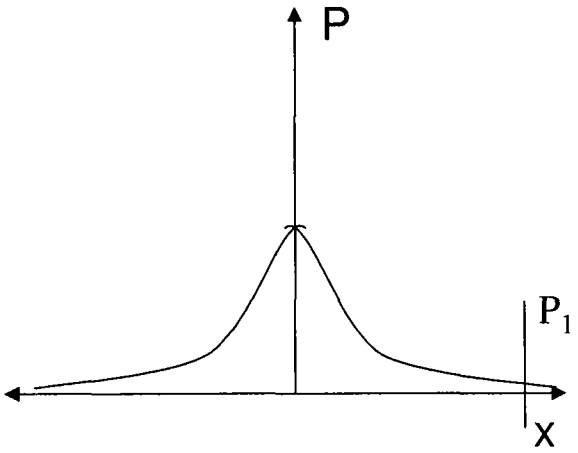
FIG. 3 is a schematic of a Gaussian probability function.

A Gaussian distribution is shown in FIG. 3. FIG. 3 can be thought of as being the probability distribution of an acoustic unit relating to a speech vector. For example, the speech vector shown as X has a probability P1 of corresponding to the phoneme or other acoustic unit which has the distribution shown in FIG. 3.

The shape and position of the Gaussian is defined by its mean and variance. These parameters are determined during the training of the system.

These parameters are then used in the acoustic model in step S107. In this description, the acoustic model is a Hidden Markov Model (HMM). However, other models could also be used.

The text of the speech system will store many probability density functions relating an to acoustic unit i.e. phoneme, grapheme, word or part thereof to speech parameters. As the Gaussian distribution is generally used, these are generally referred to as Gaussians or components.

In a Hidden Markov Model or other type of acoustic model, the probability of all potential speech vectors relating to a specific acoustic unit must be considered. Then the sequence of speech vectors which most likely corresponds to the sequence of acoustic units will be taken into account. This implies a global optimization over all the acoustic units of the sequence taking into account the way in which two units affect to each other. As a result, it is possible that the most likely speech vector for a specific acoustic unit is not the best speech vector when a sequence of acoustic units is considered.

Once a sequence of speech vectors has been determined, speech is output in step S109.

Figure 4:
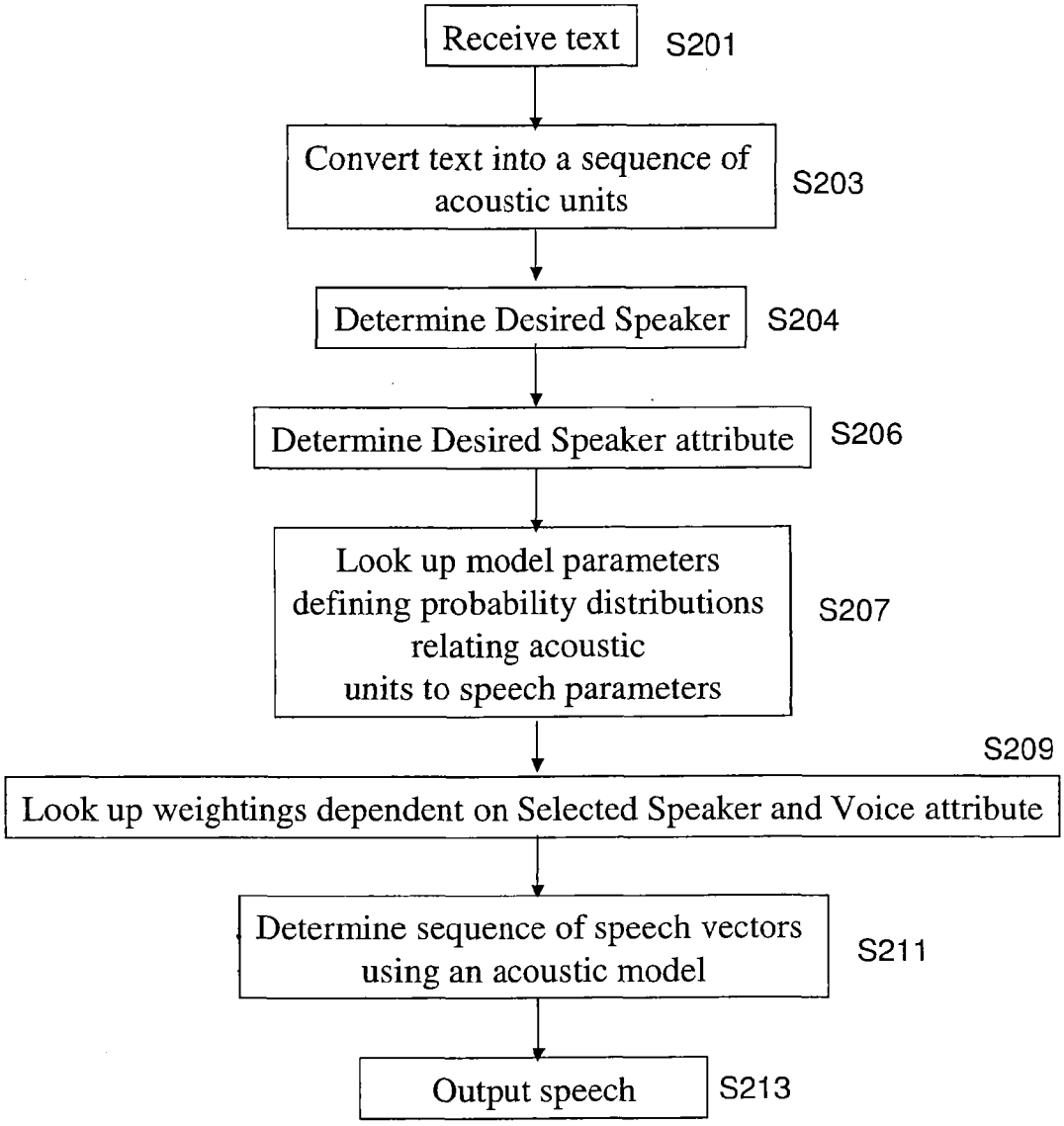
FIG. 4 is a flow diagram of a speech processing method in accordance with an embodiment of the present invention.

FIG. 4 is a flowchart of a process for a text to speech system in accordance with an embodiment of the present invention. In step S201, text is received in the same manner as described with reference to FIG. 2. The text is then converted into a sequence of acoustic units which may be phonemes, graphemes, context dependent phonemes or graphemes and words or part thereof in step S203.

The system of FIG. 4 can output speech using a number of different speakers with a number of different voice attributes. For example, in an embodiment, voice attributes may be selected from a voice sounding, happy, sad, angry, nervous, calm, commanding, etc. The speaker may be selected from a range of potential speaking voices such as a make voice, young female voice etc.

In step S204, the desired speaker is determined. This may be done by a number of different methods. Examples of some possible methods for determining the selected speakers are explained with reference to FIGS. 5 to 8.

In step S206, the speaker attribute which to be used for the voice is selected. The speaker attribute may be selected from a number of different categories. For example, the categories may be selected from emotion, accent, etc. In a method in accordance with an embodiment, the attributes may be: happy, sad, angry etc.

In the method which is described with reference to FIG. 4, each Gaussian component is described by a mean and a variance. In this particular method as well, the acoustic model which will be used has been trained using a cluster adaptive training method (CAT) where the speakers and speaker attributes are accommodated by applying weights to model parameters which have been arranged into clusters. However, other techniques are possible and will be described later.

In some embodiments, there will be a plurality of different states which will be each be modelled using a Gaussian. For example, in an embodiment, the text-to-speech system comprises multiple streams. Such streams may be selected from one or more of spectral parameters (Spectrum), Log of fundamental frequency (Log $F_0$), first differential of Log $F_0$ (Delta Log $F_0$), second differential of Log $F_0$ (Delta-Delta Log $F_0$), Band aperiodicity parameters (BAP), duration etc. The streams may also be further divided into classes such as silence (sil), short pause (pau) and speech (spe) etc. In an embodiment, the data from each of the streams and classes will be modelled using a HMM. The HMM may comprise different numbers of states, for example, in an embodiment, 5 state HMMs may be used to model the data from some of the above streams and classes. A Gaussian component is determined for each HMM state.

In the system of FIG. 4, which uses a CAT based method the mean of a Gaussian for a selected speaker is expressed as a weighted sum of independent means of the Gaussians. Thus:

$$\mu_m^{(s,e_1,\ldots e_F)} = \sum_i \lambda_i^{(s,e_1,\ldots,e_F)} \mu_{c(m,i)} \qquad \text{Eqn. 1}$$

where $\mu_m^{(s,e_1,\ldots e_F)}$ is the mean of component m in with a selected speaker voice s, and attributes $e_1, \ldots e_F$, $i \in \{1, \ldots, P\}$ is the index for a cluster with P the total number of clusters, $\lambda_i^{(s,e_1,\ldots,e_F)}$ is the speaker&attributes dependent interpolation weight of the $i^{th}$ cluster for the speaker s and attributes $e_1, \ldots e_F$; $\mu_{c(m,i)}$ is the mean for component m in cluster i. For one of the clusters, usually cluster i=1, all the weights are always set to 1.0. This cluster is called the 'bias cluster'.

In order to obtain an independent control of each factor the weights are defined as $$\lambda^{(s,e_1,\ldots,e_F)} = [1, \lambda^{(s)T}, \lambda^{(e_1)T}, \ldots, \lambda^{(e_F)T}]^T$$

So that Eqn. 1 can be rewritten as $$\mu_m^{(s,e_1,\ldots e_F)} = \mu_{c(m,1)} + \sum_i \lambda_i^{(s)} \mu_{c(m,i)}^{(s)} + \sum_{f=1}^{F} \left( \sum_i \lambda_i^{(e_f)} \mu_{c(m,i)}^{(e_f)} \right)$$

Where $\mu_{c(m,1)}$ represent the mean associated with the bias cluster, $\mu_{c(m,i)}^{(s)}$ are the means for the speaker clusters, and $\mu_{c(m,i)}^{(e_f)}$ are the means for the θ attribute. Each cluster comprises at least one decision tree. There will be a decision tree for each component in the cluster. In order to simplify the expression, $c(m,i) \in \{1, \ldots, N\}$ indicates the general leaf node index for the component m in the mean vectors decision tree for cluster $i^{th}$, with N the total number of leaf nodes across the decision trees of all the clusters. The details of the decision trees will be explained later In step S207, the system looks up the means and variances which will be stored in an accessible manner.

In step S209, the system looks up the weightings for the means for the desired speaker and attribute. It will be appreciated by those skilled in the art that the speaker and attribute dependent weightings may be looked up before or after the means are looked up in step S207.

Thus, after step S209, it is possible to obtain speaker and attribute dependent means i.e. using the means and applying the weightings, these are then used in an acoustic model in step S211 in the same way as described with reference to step S107 in FIG. 2. The speech is then output in step S213.

The means of the Gaussians are clustered. In an embodiment, each cluster comprises at least one decision tree, the decisions used in said trees are based on linguistic, phonetic and prosodic variations. In an embodiment, there is a decision tree for each component which is a member of a cluster. Prosodic, phonetic, and linguistic contexts affect the final speech waveform. Phonetic contexts typically affects vocal tract, and prosodic (e.g. syllable) and linguistic (e.g., part of speech of words) contexts affects prosody such as duration (rhythm) and fundamental frequency (tone). Each cluster may comprise one or more sub-clusters where each sub-cluster comprises at least one of the said decision trees.

The above can either be considered to retrieve a weight for each sub-cluster or a weight vector for each cluster, the components of the weight vector being the weightings for each sub-cluster.

The following configuration shows a standard embodiment. To model this data, in this embodiment, 5 state HMMs are used. The data is separated into three classes for this example: silence, short pause, and speech. In this particular embodiment, the allocation of decision trees and weights per sub-cluster are as follows.

In this particular embodiment the following streams are used per cluster:

Spectrum: 1 stream, 5 states, 1 tree per state×3 classes

Log F0: 3 streams, 5 states per stream, 1 tree per state and stream×3 classes

BAP: 1 stream, 5 states, 1 tree per state×3 classes

Duration: 1 stream, 5 states, 1 tree×3 classes (each tree is shared across all states)

Total: 3×26=78 decision trees

For the above, the following weights are applied to each stream per voice characteristic e.g. speaker:

Spectrum: 1 stream, 5 states, 1 weight per stream×3 classes

Log F0: 3 streams, 5 states per stream, 1 weight per stream×3 classes

BAP: 1 stream, 5 states, 1 weight per stream×3 classes

Duration: 1 stream, 5 states, 1 weight per state and stream×3 classes

Total: 3×10=30 weights

As shown in this example, it is possible to allocate the same weight to different decision trees (spectrum) or more than one weight to the same decision tree (duration) or any other combination. As used herein, decision trees to which the same weighting is to be applied are considered to form a sub-cluster.

In an embodiment, the mean of a Gaussian distribution with a selected speaker and attribute is expressed as a weighted sum of the means of a Gaussian component, where the summation uses one mean from each cluster, the mean being selected on the basis of the prosodic, linguistic and phonetic context of the acoustic unit which is currently being processed.

Figure 5:
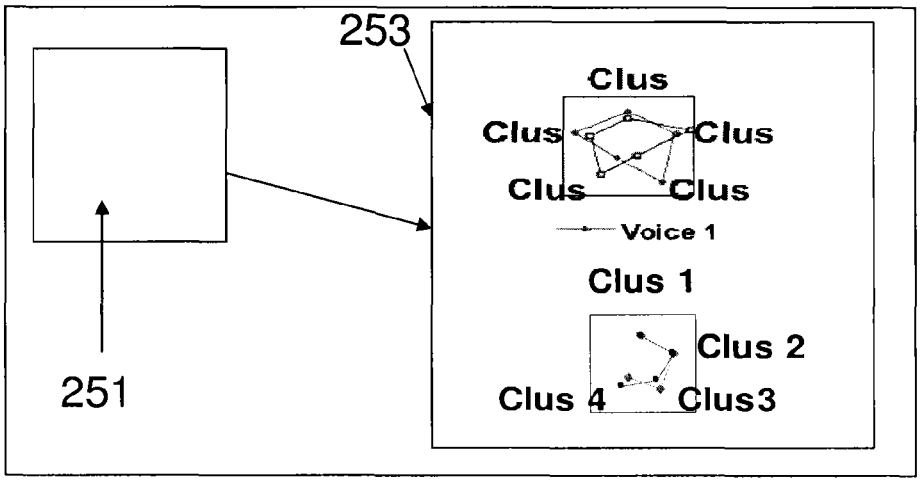
FIG. 5 is a schematic of a system showing how the voice characteristics may be selected.

FIG. 5 shows a possible method of selecting the speaker and attribute for the output voice. Here, a user directly selects the weighting using, for example, a mouse to drag and drop a point on the screen, a keyboard to input a figure etc. In FIG. 5, a selection unit 251 which comprises a mouse, keyboard or the like selects the weightings using display 253. Display 253, in this example has 2 radar charts, one for attribute and one for voice which shows the weightings. The user can use the selecting unit 251 in order to change the dominance of the various clusters via the radar charts. It will be appreciated by those skilled in the art that other display methods may be used.

In some embodiments, the weighting can be projected onto their own space, a "weights space" with initially a weight representing each dimension. This space can be re-arranged into a different space which dimensions represent different voice attributes. For example, if the modelled voice characteristic is expression, one dimension may indicate happy voice characteristics, another nervous etc, the user may select to increase the weighting on the happy voice dimension so that this voice characteristic dominates. In that case the number of dimensions of the new space is lower than that of the original weights space. The weights vector on the original space $\lambda^{(s)}$ can then be obtained as a function of the coordinates vector of the new space $\alpha^{(s)}$.

In one embodiment, this projection of the original weight space onto a reduced dimension weight space is formed using a linear equation of the type $\lambda^{(s)}=H\alpha^{(s)}$ where H is a projection matrix. In one embodiment, matrix H is defined to set on its columns the original $\lambda^{(s)}$ for d representative speakers selected manually, where d is the desired dimension of the new space. Other techniques could be used to either reduce the dimensionality of the weight space or, if the values of $\alpha^{(s)}$ are pre-defined for several speakers, to automatically find the function that maps the control $\alpha$ space to the original $\lambda$ weight space.

Figure 6:
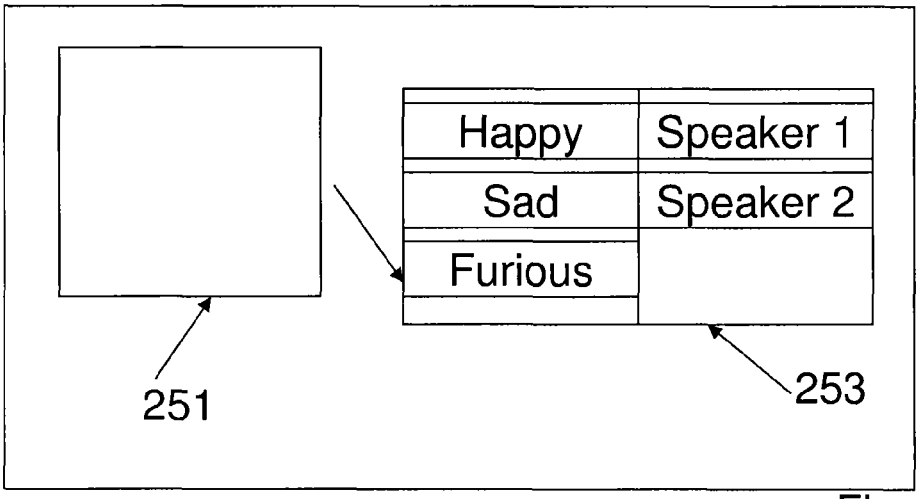
FIG. 6 is a variation on the system of FIG. 5.

In a further embodiment, the system is provided with a memory which saves predetermined sets of weightings vectors. Each vector may be designed to allow the text to be outputting with a different voice characteristic and speaker combination. For example, a happy voice, furious voice, etc in combination with any speaker. A system in accordance with such an embodiment is shown in FIG. 6. Here, the display 253 shows different voice attributes and speakers which may be selected by selecting unit 251.

The system may indicate a set of choices of speaker output based on the attributes of the predetermined sets. The user may then select the speaker required.

Figure 7:
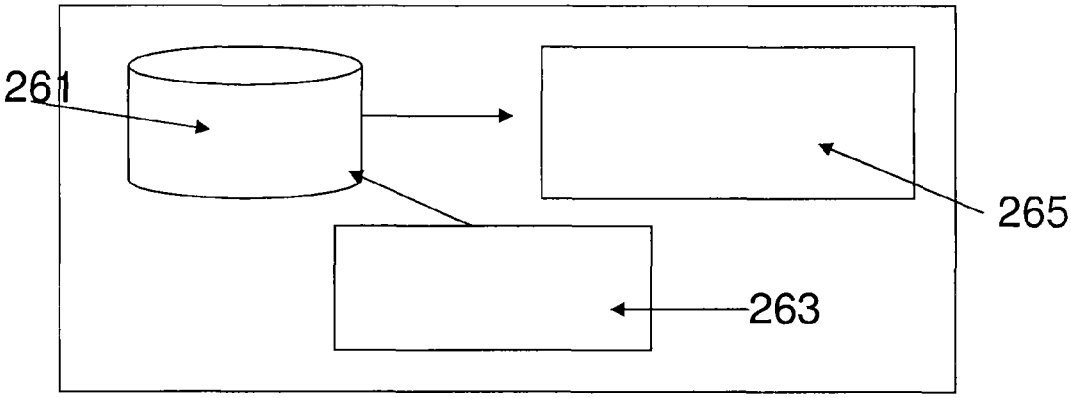
FIG. 7 is a further variation on the system of FIG. 5.

In a further embodiment, as shown in FIG. 7, the system determines the weightings automatically. For example, the system may need to output speech corresponding to text which it recognises as being a command or a question. The system may be configured to output an electronic book. The system may recognise from the text when something is being spoken by a character in the book as opposed to the narrator, for example from quotation marks, and change the weighting to introduce a new voice characteristic to the output. The system may also be configured to determine the speaker for this different speech. The system may also be configured to recognise if the text is repeated. In such a situation, the voice characteristics may change for the second output. Further the system may be configured to recognise if the text refers to a happy moment, or an anxious moment and the text outputted with the appropriate voice characteristics.

In the above system, a memory 261 is provided which stores the attributes and rules to be checked in the text. The input text is provided by unit 263 to memory 261. The rules for the text are checked and information concerning the type of voice characteristics are then passed to selector unit 265. Selection unit 265 then looks up the weightings for the selected voice characteristics.

The above system and considerations may also be applied for the system to be used in a computer game where a character in the game speaks.

Figure 8:
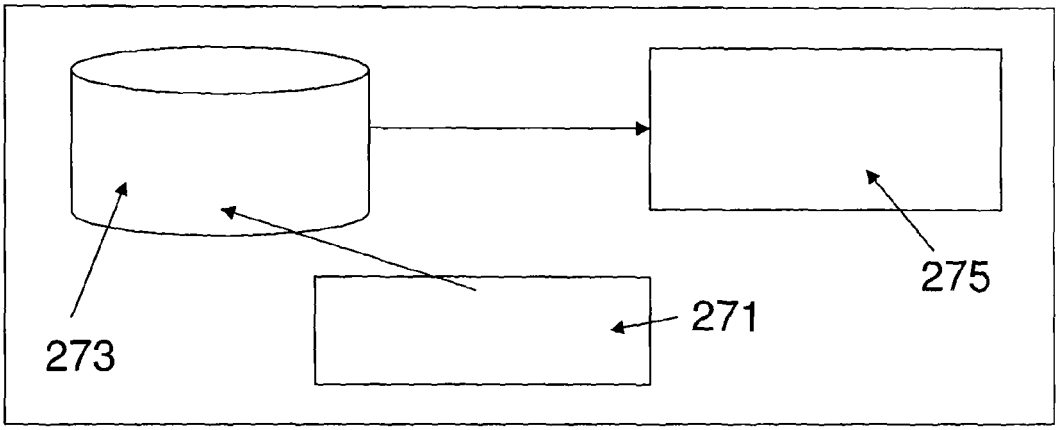
FIG. 8 is a yet further variation on the system of FIG. 5.

In a further embodiment, the system receives information about the text to be outputted from a further source. An example of such a system is shown in FIG. 8. For example, in the case of an electronic book, the system may receive inputs indicating how certain parts of the text should be outputted and the speaker for those parts of text.

In a computer game, the system will be able to determine from the game whether a character who is speaking has been injured, is hiding so has to whisper, is trying to attract the attention of someone, has successfully completed a stage of the game etc.

In the system of FIG. 8, the further information on how the text should be outputted is received from unit 271. Unit 271 then sends this information to memory 273. Memory 273 then retrieves information concerning how the voice should be output and send this to unit 275. Unit 275 then retrieves the weightings for the desired voice output both the speaker and the desired attribute.

Next, the training of a system in accordance with an embodiment of the present invention will be described with reference to FIGS. 9 to 13 First, training in relation to a CAT based system will be described.

Figure 9:
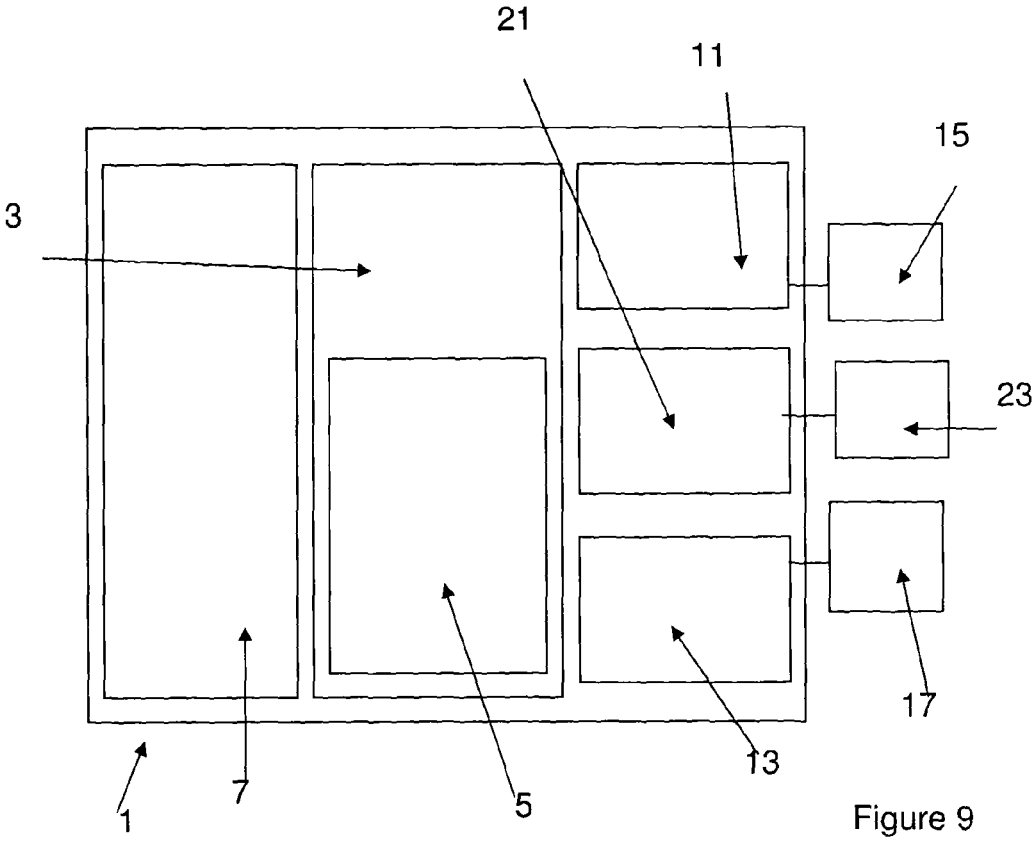
FIG. 9 is schematic of a text to speech system which can be trained.

The system of FIG. 9 is similar to that described with reference to FIG. 1. Therefore, to avoid any unnecessary repetition, like reference numerals will be used to denote like features.

In addition to the features described with reference to FIG. 1, FIG. 9 also comprises an audio input 23 and an audio input module 21. When training a system, it is necessary to have an audio input which matches the text being inputted via text input 15.

In speech processing systems which are based on Hidden Markov Models (HMMs), the HMM is often expressed as:

$$M=(A,B,\pi) \qquad \text{Eqn. 2}$$

where $A=\{a_{ij}\}_{i,j=1}^{N}$ and is the state transition probability distribution, $B=\{b_j(o)\}_{j=1}^{N}$ is the state output probability distribution and $\pi=\{\pi_i\}_{i=1}^{N}$ is the initial state probability distribution and where N is the number of states in the HMM.

How a HMM is used in a text-to-speech system is well known in the art and will not be described here.

In the current embodiment, the state transition probability distribution A and the initial state probability distribution are determined in accordance with procedures well known in the art. Therefore, the remainder of this description will be concerned with the state output probability distribution.

Generally in text to speech systems the state output vector or speech vector o(t) from an $m^{th}$ Gaussian component in a model set $\mathcal{M}$ is $$P(o(t)|m,s,e,\mathcal{M})=N(o(t));\mu_m^{(s,e)},\Sigma_m^{(s,e)}) \qquad \text{Eqn. 3}$$

where $\mu^{(s,e)}_m$ and $\Sigma^{(s,e)}_m$ are the mean and covariance of the $m^{th}$ Gaussian component for speaker s and expression e.

The aim when training a conventional text-to-speech system is to estimate the Model parameter set $\mathcal{M}$ which maximises likelihood for a given observation sequence. In the conventional model, there is one single speaker and expression, therefore the model parameter set is $\mu^{(s,e)}_m=\mu_m$ and $\Sigma^{(s,e)}_m=\Sigma_m$ for the all components m.

As it is not possible to obtain the above model set based on so called Maximum Likelihood (ML) criteria purely analytically, the problem is conventionally addressed by using an iterative approach known as the expectation maximisation (EM) algorithm which is often referred to as the Baum-Welch algorithm. Here, an auxiliary function (the "Q" function) is derived:

$$Q(M, M') = \sum_{m,t} \gamma_m(t)\log p(o(t), m \mid M) \qquad \text{Eqn 4}$$

where $\gamma_m$ (t) is the posterior probability of component m generating the observation o(t) given the current model parameters $\mathcal{M}'$ and $\mathcal{M}$ is the new parameter set. After each iteration, the parameter set $\mathcal{M}'$ is replaced by the new parameter set $\mathcal{M}$ which maximises $Q(\mathcal{M}, \mathcal{M}')$. $p(o(t), m|\mathcal{M})$ is a generative model such as a GMM, HMM etc.

In the present embodiment a HMM is used which has a state output vector of:

$$P(o(t)|m,s,e,\mathcal{M})=N(o(t);\hat{\mu}_m^{(s,e)},\hat{\Sigma}_{v(m)}^{(s,e)}) \qquad \text{Eqn. 5}$$

Where $m \in \{1, \ldots, MN\}$, $t \in \{1, \ldots, T\}$, $s \in \{1, \ldots, S\}$ and $e \in \{1, \ldots, E\}$ are indices for component, time speaker and expression respectively and where MN, T, S and E are the total number of components, frames, speakers and expressions respectively.

The exact form of $\hat{\mu}_m^{(s,e)}$ and $\hat{\Sigma}_m^{(s,e)}$ depends on the type of speaker and expression dependent transforms that are applied. In the most general way the speaker dependent transforms includes:

- a set of speaker-expression dependent weights $\lambda_{q(m)}^{(s,e)}$
- a speaker-expression-dependent cluster $\mu_{c(m,x)}^{(s,e)}$
- a set of linear transforms $[A_{r(m)}^{(s,e)}, b_{r(m)}^{(s,e)}]$ whereby these transform could depend just on the speaker, just on the expression or on both.

After applying all the possible speaker dependent transforms in step 211, the mean vector $\hat{\mu}_m^{(s,e)}$ and covariance matrix $\hat{\Sigma}_m^{(s,e)}$ of the probability distribution m for speaker s and expression e become $$\hat{\mu}_m^{(s,e)} = A_{r(m)}^{(s,e)-1}\left(\sum_i \lambda_i^{(s,e)}\mu_{c(m,i)} + (\mu_{c(m,x)}^{(s,e)} - b_{r(m)}^{(s,e)})\right) \qquad \text{Eqn 6}$$

$$\hat{\Sigma}_m^{(s,e)} = (A_{r(m)}^{(s,e)T}\Sigma_{v(m)}^{-1}A_{r(m)}^{(s,e)})^{-1} \qquad \text{Eqn. 7}$$

where $\mu_{c(m,j)}$ are the means of cluster 1 for component m as described in Eqn. 1, $\mu_{c(m,x)}^{(s,e)}$ is the mean vector for component m of the additional cluster for speaker s expression s, which will be described later, and $A_{r(m)}^{(s,e)}$ and $b_{r(m)}^{(s,e)}$ are the linear transformation matrix and the bias vector associated with regression class r(m) for the speaker s, expression e. R is the total number of regression classes and $r(m) \in \{1, \ldots, R\}$ denotes the regression class to which the component m belongs.

If no linear transformation is applied $A_{r(m)}^{(s,e)}$ and $b_{r(m)}^{(s,e)}$ become an identity matrix and zero vector respectively.

For reasons which will be explained later, in this embodiment, the covariances are clustered and arranged into decision trees where $v(m) \in \{1, \ldots, V\}$ denotes the leaf node in a covariance decision tree to which the co-variance matrix of the component m belongs and V is the total number of variance decision tree leaf nodes.

Using the above, the auxiliary function can be expressed as:

$$Q(\mathcal{M}, \mathcal{M}') = -\frac{1}{2}\sum_{m,t,s}\gamma_m(t)\left\{\log\left|\hat{\Sigma}_{v(m)}\right| + \left(o(t)-\hat{\mu}_m^{(s,e)}\right)^T\hat{\Sigma}_{v(m)}^{-1}\left(o(t)-\hat{\mu}_m^{(s,e)}\right)\right\} + C \qquad \text{Eqn 8}$$

where C is a constant independent of $\mathcal{M}$.

Thus, using the above and substituting equations 6 and 7 in equation 8, the auxiliary function shows that the model parameters may be split into four distinct parts.

The first part are the parameters of the canonical model i.e. speaker and expression independent means $\{\mu_n\}$ and the speaker and expression independent covariance $\{\Sigma_k\}$ the above indices n and k indicate leaf nodes of the mean and variance decision trees which will be described later. The second part are the speaker-expression dependent weights $\{\lambda_i^{(s,e)}\}_{s,e,i}$ where s indicates speaker, e indicates expression and i the cluster index parameter. The third part are the means of the speaker-expression dependent cluster $\mu_{c(m,x)}$ and the fourth part are the CMLLR constrained maximum likelihood linear regression. transforms $\{A_d^{(s,e)}, b_d^{(s,e)}\}_{s,e,d}$ where s indicates speaker, e expression and d indicates component or speaker-expression regression class to which component m belongs.

Once the auxiliary function is expressed in the above manner, it is then maximized with respect to each of the variables in turn in order to obtain the ML values of the speaker and voice characteristic parameters, the speaker dependent parameters and the voice characteristic dependent parameters.

In detail, for determining the ML estimate of the mean, the following procedure is performed:

To simplify the following equations it is assumed that no linear transform is applied. If a linear transform is applied, the original observation vectors $\{o_r(t)\}$ have to be substituted by the transform ones $$\{\hat{o}_{r(m)}^{(s,e)}(t)=A_{r(m)}^{(s,e)}o(t)+b_{r(m)}^{(s,e)}\} \quad \text{Eqn. 9}$$

Similarly, it will be assumed that there is no additional cluster. The inclusion of that extra cluster during the training is just equivalent to adding a linear transform on which $A_{r(m)}^{(s,e)}$ is the identity matrix and $\{b_{r(m)}^{(s,e)}=\mu_{c(m,x)}^{(s,e)}\}$ First, the auxiliary function of equation 4 is differentiated with respect to $\mu_n$ as follows:

$$\frac{\partial Q(\mathcal{M};\hat{\mathcal{M}})}{\partial \mu_n} = k_n - G_{nn}\mu_n - \sum_{v\neq n} G_{nv}\mu_v \quad \text{Eqn. 10}$$

Where $$G_{nv} = \sum_{\substack{m,i,j\\ c(m,i)=n\\ c(m,j)=v}} G_{ij}^{(m)}, \quad \text{Eqn. 11}$$

$$k_n \sum_{\substack{m,i\\ c(m,i)=n}} k_i^{(m)}.$$

with $G_{ij}^{(m)}$ and $k_i^{(m)}$ accumulated statistics $$G_{ij}^{(m)} = \sum_{t,s,e} \gamma_m(t,s,e)\lambda_{i,q(m)}^{(s,e)}\Sigma_{v(m)}^{-1}\gamma_{j,q(m)}^{(s,e)} \quad \text{Eqn. 12}$$

$$k_i^{(m)} = \sum_{t,s,e} \gamma_m(t,s,e)\lambda_{i,q(m)}^{(s,e)}\Sigma_{v(m)}^{-1}o(t).$$

By maximizing the equation in the normal way by setting the derivative to zero, the following formula is achieved for the ML estimate of $\mu_n$ i.e. $\hat{\mu}_n$:

$$\hat{\mu}_n = G_{nn}^{-1}\left(k_n - \sum_{v\neq n} G_{nv}\mu_v\right) \quad \text{Eqn. 13}$$

It should be noted, that the ML estimate of $\mu_n$ also depends on $\mu_k$ where k does not equal n. The index n is used to represent leaf nodes of decisions trees of mean vectors, whereas the index k represents leaf modes of covariance decision trees. Therefore, it is necessary to perform the optimization by iterating over all $\mu_n$ until convergence.

This can be performed by optimizing all $\mu_n$ simultaneously by solving the following equations.

$$\begin{bmatrix} G_{11} & \dots & G_{1N} \\ \vdots & \ddots & \vdots \\ G_{N1} & \dots & G_{NN} \end{bmatrix}\begin{bmatrix} \hat{\mu}_1 \\ \vdots \\ \hat{\mu}_N \end{bmatrix} = \begin{bmatrix} k_1 \\ \vdots \\ k_N \end{bmatrix}, \quad \text{Eqn. 14}$$

However, if the training data is small or N is quite large, the coefficient matrix of equation 7 cannot have full rank. This problem can be avoided by using singular value decomposition or other well-known matrix factorization techniques.

The same process is then performed in order to perform an ML estimate of the covariances i.e. the auxiliary function shown in equation (8) is differentiated with respect to $\Sigma_k$ to give:

$$\hat{\Sigma}_k = \frac{\sum_{\substack{t,s,e,m\\ v(m)=k}} \gamma_m(t,s,e)\bar{o}_{q(m)}^{(s,e)}(t)\bar{o}_{q(m)}^{(s,e)}(t)^T}{\sum_{\substack{t,s,e,m\\ v(m)=k}} \gamma_m(t,s,e)} \quad \text{Eqn. 15}$$

Where $$\bar{o}_{q(m)}^{(s,e)}(t) = o(t) - M_m\lambda_q^{(s,e)} \quad \text{Eqn. 16}$$

The ML estimate for speaker dependent weights and the speaker dependent linear transform can also be obtained in the same manner i.e. differentiating the auxiliary function with respect to the parameter for which the ML estimate is required and then setting the value of the differential to 0.

For the expression dependent weights this yields $$\lambda_q^{(e)} = \left(\sum_{\substack{t,m,s\\ q(m)=q}} \gamma_m(t,s,e)M_m^{(e)T}\Sigma_{v(m)}^{-1}M_m^{(e)}\right)^{-1} \sum_{\substack{t,m,s\\ q(m)=q}} \gamma_m(t,s,e)M_m^{(e)T}\Sigma_{v(m)}^{-1}\hat{o}_{q(m)}^{(s)}(t) \quad \text{Eqn. 17}$$

Where $$\hat{o}_{q(m)}^{(s)}(t) = o(t) - \mu_{c(m,1)} - M_m^{(s)}\lambda_q^{(s)}$$

And similarly, for the speaker-dependent weights $$\lambda_q^{(s)} = \left(\sum_{\substack{t,m,e\\ q(m)=q}} \gamma_m(t,s,e)M_m^{(s)T}\Sigma_{v(m)}^{-1}M_m^{(s)}\right)^{-1} \sum_{\substack{t,m,e\\ q(m)=q}} \gamma_m(t,s,e)M_m^{(s)T}\Sigma_{v(m)}^{-1}\hat{o}_{q(m)}^{(e)}(t)$$

Where $$\hat{o}_{q(m)}^{(e)}(t) = o(t) - \mu_{c(m,1)} - M_m^{(e)}\lambda_q^{(e)}$$

In a preferred embodiment, the process is performed in an iterative manner. This basic system is explained with reference to the flow diagrams of FIGS. 10 to 12.

In step S401, a plurality of inputs of audio speech are received. In this illustrative example, 4 speakers are used.

Next, in step S403, an acoustic model is trained and produced for each of the 4 voices, each speaking with neutral emotion. In this embodiment, each of the 4 models is only trained using data from one voice. S403 will be explained in more detail with reference to the flow chart of FIG. 11.

Figure 11:
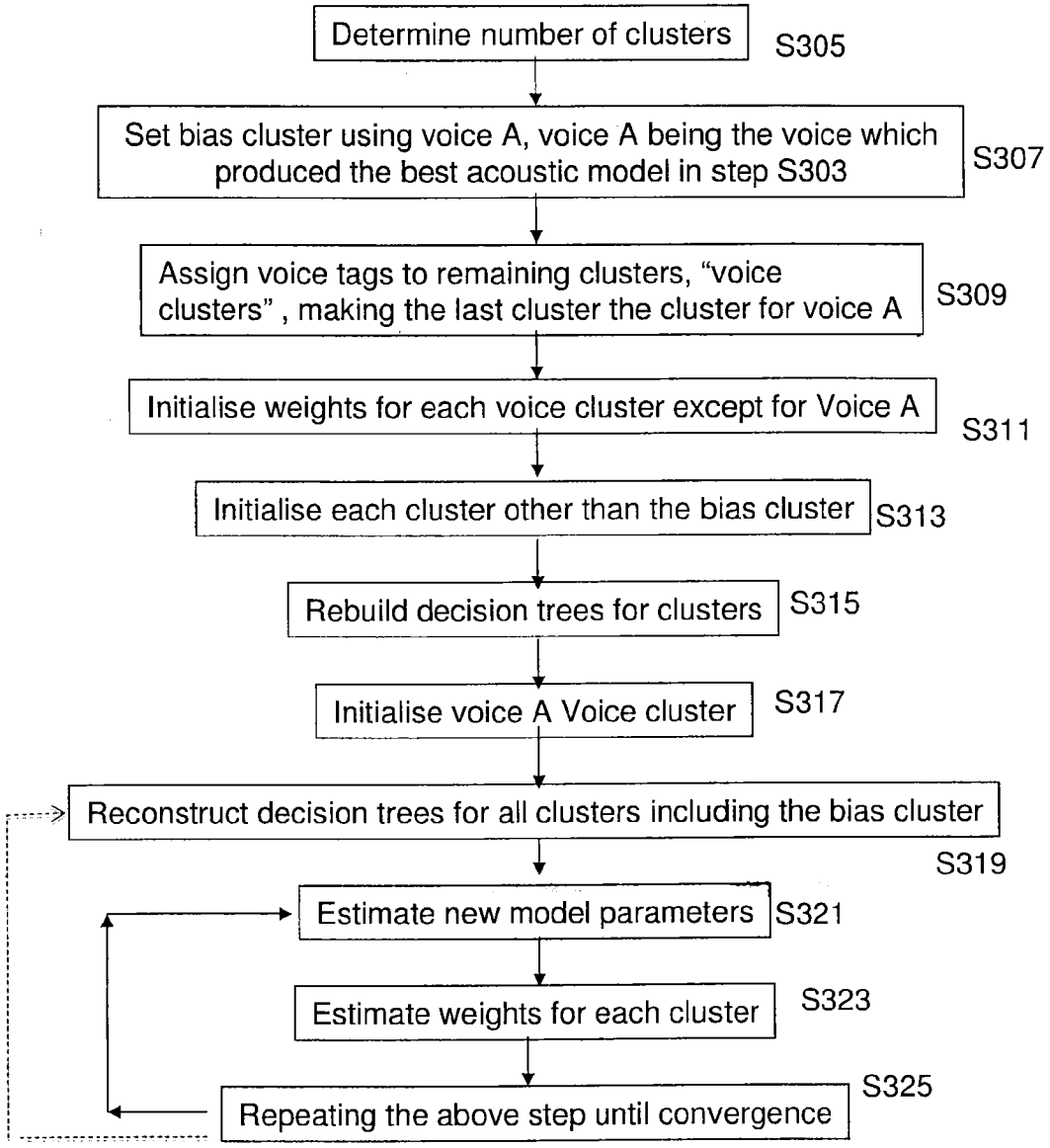
FIG. 11 is a flow diagram showing in more detail some of the steps for training the speaker clusters of FIG. 10.
Figure 12:
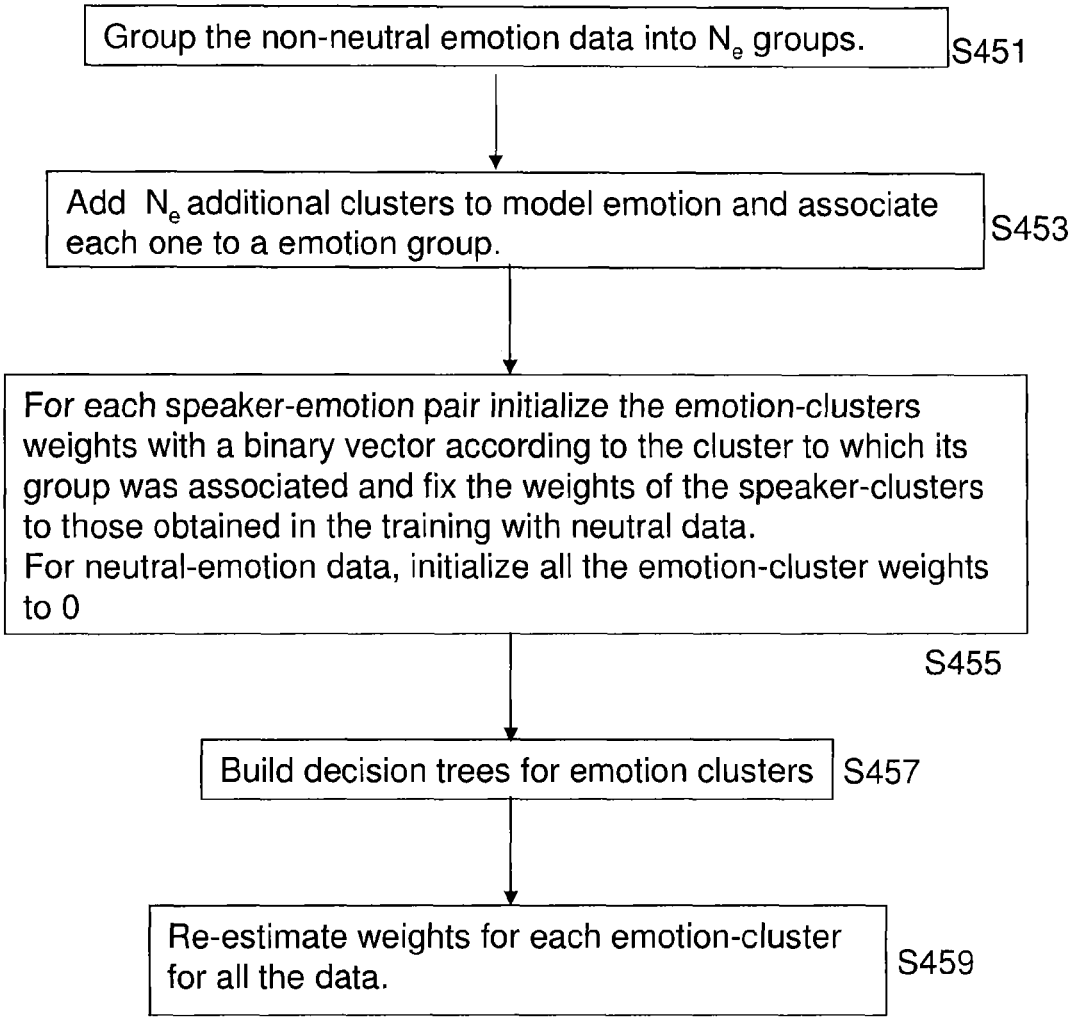
FIG. 12 is a flow diagram showing in more detail some of the steps for training the clusters relating to attributes of FIG. 10.

In step S305 of FIG. 11, the number of clusters P is set to V+1, where V is the number of voices (4).

In step S307, one cluster (cluster 1), is determined as the bias cluster. The decision trees for the bias cluster and the associated cluster mean vectors are initialised using the voice which in step S303 produced the best model. In this example, each voice is given a tag "Voice A", "Voice B", "Voice C" and "Voice D", here Voice A is assumed to have produced the best model. The covariance matrices, space weights for multi-space probability distributions (MSD) and their parameter sharing structure are also initialised to those of the voice A model.

Each binary decision tree is constructed in a locally optimal fashion starting with a single root node representing all contexts. In this embodiment, by context, the following bases are used, phonetic, linguistic and prosodic. As each node is created, the next optimal question about the context is selected. The question is selected on the basis of which question causes the maximum increase in likelihood and the terminal nodes generated in the training examples.

Then, the set of terminal nodes is searched to find the one which can be split using its optimum question to provide the largest increase in the total likelihood to the training data. Providing that this increase exceeds a threshold, the node is divided using the optimal question and two new terminal nodes are created. The process stops when no new terminal nodes can be formed since any further splitting will not exceed the threshold applied to the likelihood split.

Figure 13:
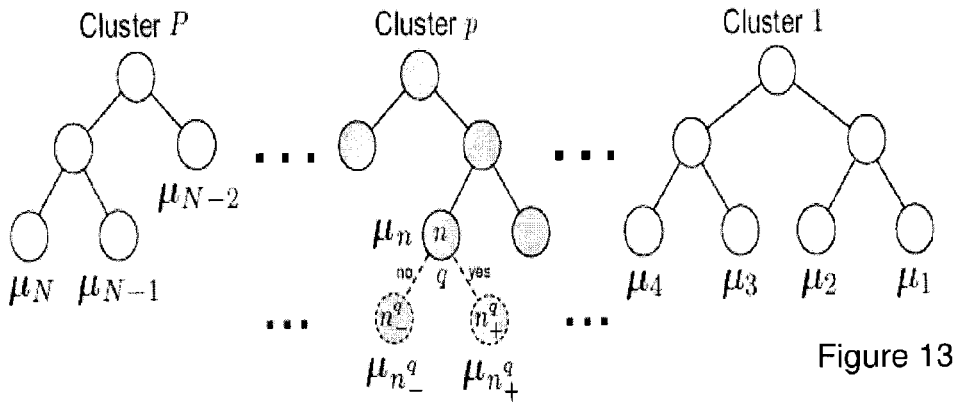
FIG. 13 is a schematic of decision trees used by embodiments in accordance with the present invention.

This process is shown for example in FIG. 13. The nth terminal node in a mean decision tree is divided into two new terminal nodes $n_+^q$ and $n_-^q$ of by a question q. The likelihood gain achieved by this split can be calculated as follows:

$$\mathcal{L}(n) = -\frac{1}{N}\mu_n^T\left(\sum_{m\in S(n)} G_{ii}^{(m)}\right)\mu_n + \mu_n^T\sum_{m\in S(n)}\left(k_i^{(m)} - \sum_{j\neq i} G_{ij}^{(m)}\mu_{c(m,j)}\right) \quad \text{Eqn 18}$$

Where S(n) denotes a set of components associated with node n. Note that the terms which are constant with respect to $\mu_n$ are not included.

Where C is a constant term independent of $\mu_n$. The maximum likelihood of $\mu_n$ is given by equation 13 Thus, the above can be written as:

$$\mathcal{L}(n) = \frac{1}{2}\hat{\mu}_n^T\left(\sum_{m\in S(n)} G_{ii}^{(m)}\right)\hat{\mu}_n \quad \text{Eqn. 19}$$

Thus, the likelihood gained by splitting node n into $n_+^q$ and $n_-^q$ is given by:

$$\Delta\mathcal{L}(n;q) = \mathcal{L}(n_+^q) + \mathcal{L}(n_-^q) - \mathcal{L}(n) \quad \text{Eqn. 20}$$

Thus, using the above, it is possible to construct a decision tree for each cluster where the tree is arranged so that the optimal question is asked first in the tree and the decisions are arranged in hierarchical order according to the likelihood of splitting. A weighting is then applied to each cluster.

Decision trees might be also constructed for variance. The covariance decision trees are constructed as follows: If the case terminal node in a covariance decision tree is divided into two new terminal nodes $k_+^q$ and $k_-^q$ by question q, the cluster covariance matrix and the gain by the split are expressed as follows:

$$\Sigma_k = \frac{\sum_{\substack{m,t,s,e\\ v(m)=k}} \gamma_m(t)\Sigma_{v(m)}}{\sum_{\substack{m,t,s,e\\ v(m)=k}} \gamma_m(t)} \quad \text{Eqn. 21}$$

$$\mathcal{L}(k) = -\frac{1}{2}\sum_{\substack{m,t,s,e\\ v(m)=k}} \gamma_m(t, s, e)\log|\Sigma_k| + D \quad \text{Eqn. 22}$$

where D is constant independent of $\{\Sigma_k\}$. Therefore the increment in likelihood is $$\Delta\mathcal{L}(k,q) = \mathcal{L}(k_+^q) + \mathcal{L}(k_-^q) - \mathcal{L}(k) \quad \text{Eqn. 23}$$

In step S309, a specific voice tag is assigned to each of 2, . . . , P clusters e.g. clusters 2, 3, 4, and 5 are for speakers B, C, D and A respectively. Note, because voice A was used to initialise the bias cluster it is assigned to the last cluster to be initialised.

In step S311, a set of CAT interpolation weights are simply set to 1 or 0 according to the assigned voice tag as:

$$\lambda_i^{(s)} = \begin{cases} 1.0 & \text{if } i = 0 \\ 1.0 & \text{if } voicetag(s) = i \\ 0.0 & \text{otherwise} \end{cases}$$

In this embodiment, there are global weights per speaker, per stream.

In step S313, for each cluster 2, . . . , (P−1) in turn the clusters are initialised as follows. The voice data for the associated voice, e.g. voice B for cluster 2, is aligned using the mono-speaker model for the associated voice trained in step S303. Given these alignments, the statistics are computed and the decision tree and mean values for the cluster are estimated. The mean values for the cluster are computed as the normalised weighted sum of the cluster means using the weights set in step S311 i.e. in practice this results in the mean values for a given context being the weighted sum (weight 1 in both cases) of the bias cluster mean for that context and the voice B model mean for that context in cluster 2.

In step S315, the decision trees are then rebuilt for the bias cluster using all the data from all 4 voices, and associated means and variance parameters re-estimated.

After adding the clusters for voices B, C and D the bias cluster is re-estimated using all 4 voices at the same time.

In step S317, Cluster P (voice A) is now initialised as for the other clusters, described in step S313, using data only from voice A.

Once the clusters have been initialised as above, the CAT model is then updated/trained as follows:

In step S319 the decision trees are re-constructed cluster-by-cluster from cluster 1 to P, keeping the CAT weights fixed. In step S321, new means and variances are estimated in the CAT model. Next in step S323, new CAT weights are estimated for each cluster. In an embodiment, the process loops back to S321 until convergence. The parameters and weights are estimated using maximum likelihood calculations performed by using the auxiliary function of the Baum-Welch algorithm to obtain a better estimate of said parameters.

As previously described, the parameters are estimated via an iterative process.

In a further embodiment, at step S323, the process loops back to step S319 so that the decision trees are reconstructed during each iteration until convergence.

Figure 10:
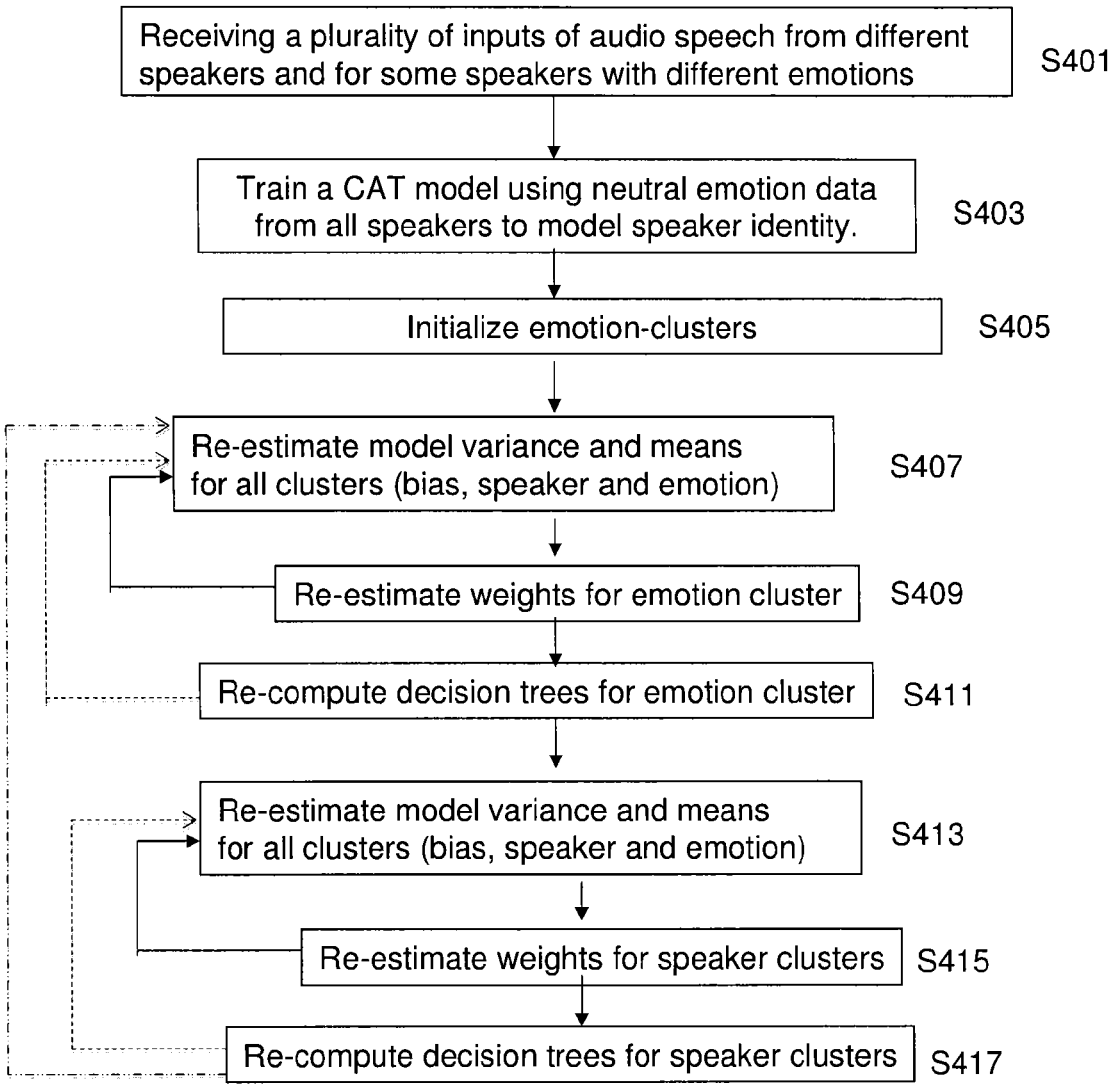
FIG. 10 is a flow diagram demonstrating a method of training a speech processing system in accordance with an embodiment of the present invention.

The process then returns to step S405 of FIG. 10 where the model is then trained for different attributes. In this particular example, the attribute is emotion.

In this embodiment, emotion in a speaker's voice is modelled using cluster adaptive training in the same manner as described for modelling the speaker's voice instep S403. First, "emotion clusters" are initialised in step S405. This will be explained in more detail with reference to FIG. 12

Data is then collected for at least one of the speakers where the speaker's voice is emotional. It is possible to collect data from just one speaker, where the speaker provides a number of data samples, each exhibiting a different emotions or a plurality of the speakers providing speech data samples with different emotions. In this embodiment, it will be presumed that the speech samples provided to train the system to exhibit emotion come from the speakers whose data was collected to train the initial CAT model in step S403. However, the system can also train to exhibit emotion using data from a speaker whose data was not used in S403 and this will be described later.

In step S451, the non-Neutral emotion data is then grouped into $N_e$ groups. In step S453, $N_e$ additional clusters are added to model emotion. A cluster is associated with each emotion group. For example, a cluster is associated with "Happy", etc.

These emotion clusters are provided in addition to the neutral speaker clusters formed in step S403.

In step S455, initialise a binary vector for the emotion cluster weighting such that if speech data is to be used for training exhibiting one emotion, the cluster is associated with that emotion is set to "1" and all other emotion clusters are weighted at "0".

During this initialisation phase the neutral emotion speaker clusters are set to the weightings associated with the speaker for the data.

Next, the decision trees are built for each emotion cluster in step S457. Finally, the weights are re-estimated based on all of the data in step S459.

After the emotion clusters have been initialised as explained above, the Gaussian means and variances are re-estimated for all clusters, bias, speaker and emotion in step S407.

Next, the weights for the emotion clusters are re-estimated as described above in step S409. The decision trees are then re-computed in step S411. Next, the process loops back to step S407 and the model parameters, followed by the weightings in step S409, followed by reconstructing the decision trees in step S411 are performed until convergence. In an embodiment, the loop S407-S409 is repeated several times.

Next, in step S413, the model variance and means are re-estimated for all clusters, bias, speaker and emotion. In step S415 the weights are re-estimated for the speaker clusters and the decision trees are rebuilt in step S417. The process then loops back to step S413 and this loop is repeated until convergence. Then the process loops back to step S407 and the loop concerning emotions is repeated until converge. The process continues until convergence is reached for both loops jointly.

FIG. 13 shows clusters 1 to P which are in the forms of decision trees. In this simplified example, there are just four terminal nodes in cluster 1 and three terminal nodes in cluster P. It is important to note that the decision trees need not be symmetric i.e. each decision tree can have a different number of terminal nodes. The number of terminal nodes and the number of branches in the tree is determined purely by the log likelihood splitting which achieves the maximum split at the first decision and then the questions are asked in order of the question which causes the larger split. Once the split achieved is below a threshold, the splitting of a node terminates.

The above produces a canonical model which allows the following synthesis to be performed:

1. Any of the 4 voices can be synthesised using the final set of weight vectors corresponding to that voice in combination with any attribute such as emotion for which the system has been trained. Thus, in the case that only "happy" data exists for speaker 1, providing that the system has been trained with "angry" data for at least one of the other voices, it is possible for system to output the voice of speaker 1 with the "angry emotion".

2. A random voice can be synthesised from the acoustic space spanned by the CAT model by setting the weight vectors to arbitrary positions and any of the trained attributes can be applied to this new voice.

3. The system may also be used to output a voice with 2 or more different attributes. For example, a speaker voice may be outputted with 2 different attributes, for example an emotion and an accent.

To model different attributes which can be combined such as accent and emotion, the two different attributes to be combined are incorporated as described in relation to equation 3 above.

In such an arrangement, one set of clusters will be for different speakers, another set of clusters for emotion and a final set of clusters for accent. Referring back to FIG. 10, the emotion clusters will be initialised as explained with reference to FIG. 12, the accent clusters will also be initialised as an additional group of clusters as explained with reference to FIG. 12 as for emotion. FIG. 10 shows that there is a separate loop for training emotion then a separate loop for training speaker. If the voice attribute is to have 2 components such as accent and emotion, there will be a separate loop for accent and a separate loop for emotion.

Figure 14:
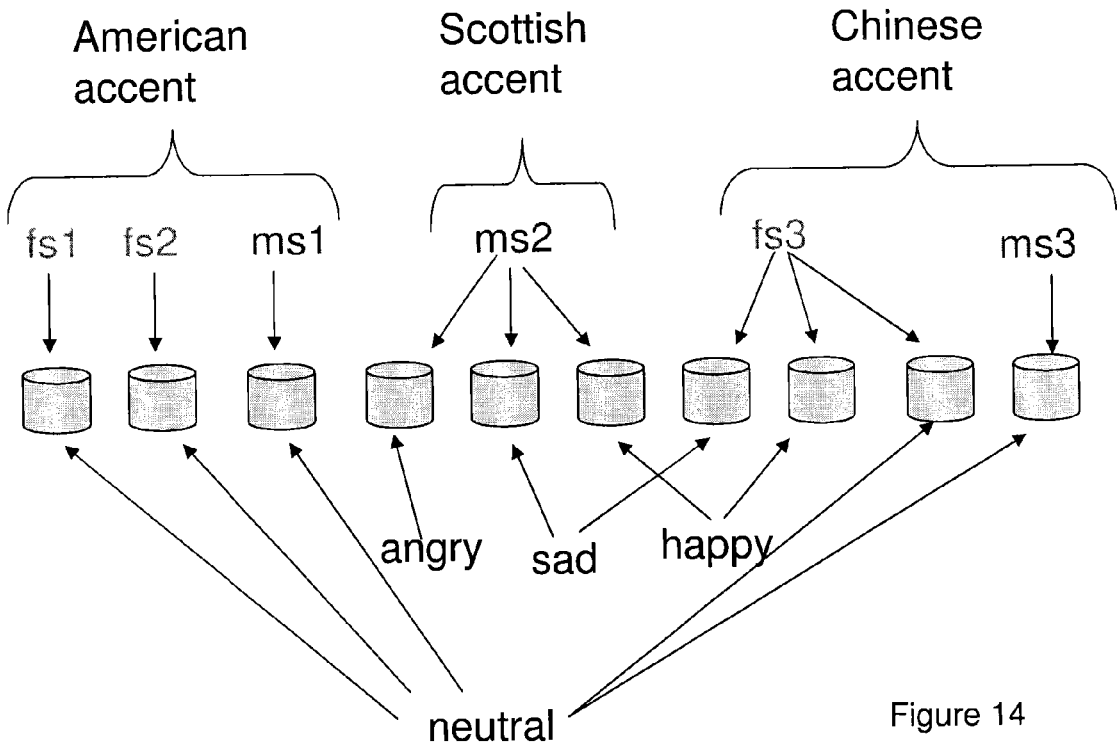
FIG. 14 is a schematic showing a collection of different types of data suitable for training a system using a method of FIG. 10.

The framework of the above embodiment allows the models to be trained jointly, thus enhancing both the controllability and the quality of the generated speech. The above also allows for the requirements for the range of training data to be more relaxed. For example, the training data configuration shown in FIG. 14 could be used where there are:

3 female speakers—fs1; fs2; and fs3

3 male speakers—ms1, ms2 and ms3 where fs1 and fs2 have an American accent and are recorded speaking with neutral emotion, fs3 has a Chinese accent and is recorded speaking for 3 lots of data, where one data set shows neutral emotion, one data set shows happy emotion and one data set angry emotion. Male speaker ms1 has an American accent is recorded only speaking with neutral emotion, male speaker ms2 has a Scottish accent and is recorded for 3 data sets speaking with the emotions of angry, happy and sad. The third male speaker ms3 has a Chinese accent and is recorded speaking with neutral emotion. The above system allows voice data to be output with any of the 6 speaker voices with any of the recorded combinations of accent and emotion.

In an embodiment, there is overlap between the voice attributes and speakers such that the grouping of the data used for training the clusters is unique for each voice characteristic.

In a further example, the assistant is used to synthesise a voice characteristic where the system is given an input of a target speaker voice which allows the system to adapt to a new speaker or the system may be given data with a new voice attribute such as accent or emotion.

A system in accordance with an embodiment of the present invention may also adapt to a new speaker and/or attribute.

Figure 15:
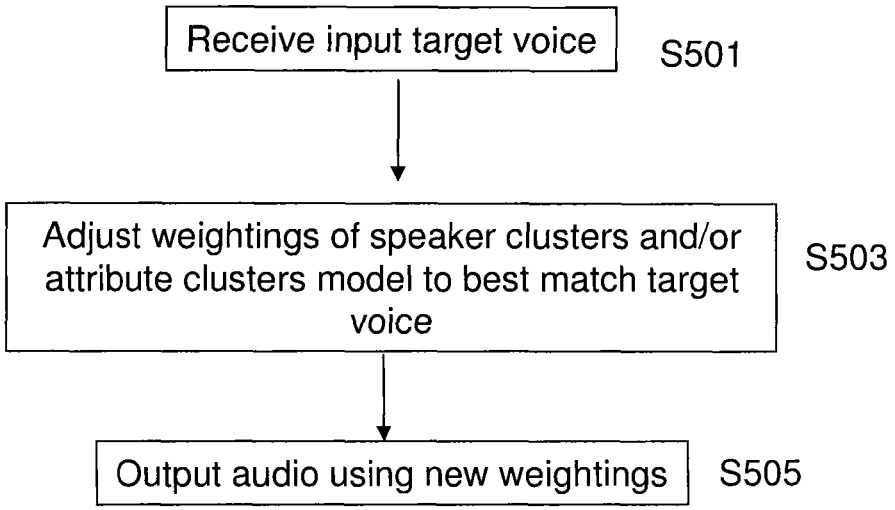
FIG. 15 is a flow diagram showing the adapting of a system in accordance with an embodiment of the present invention.

FIG. 15 shows one example of the system adapting to a new speaker with neutral emotion. First, the input target voice is received at step 501. Next, the weightings of the canonical model i.e. the weightings of the clusters which have been previously trained, are adjusted to match the target voice in step 503.

The audio is then outputted using the new weightings derived in step S503.

In a further embodiment, a new neutral emotion speaker cluster may be initialised and trained as explained with reference to FIGS. 10 and 11.

Figure 16:
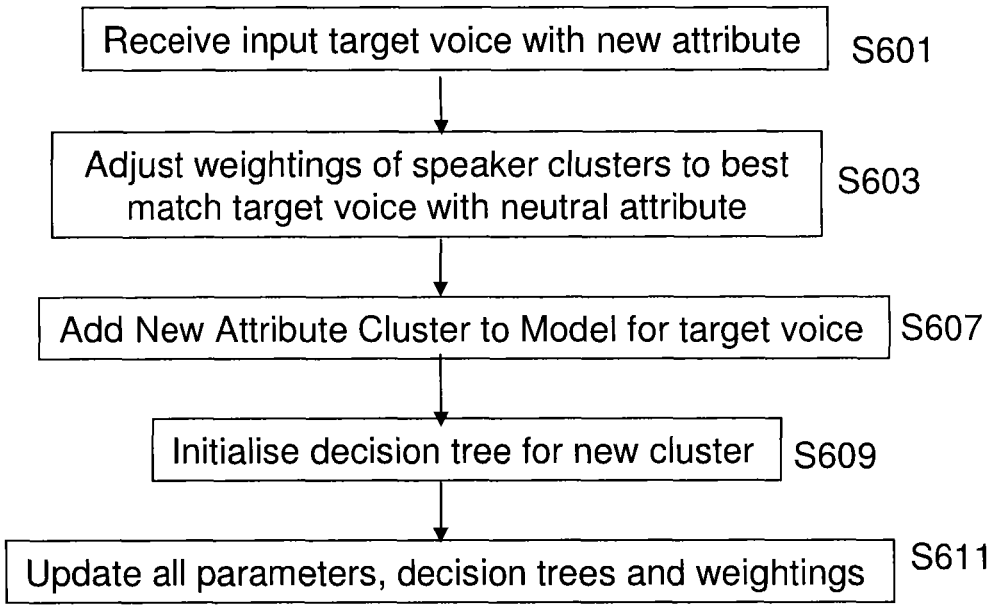
FIG. 16 is a flow diagram showing the adapting of a system in accordance with a further embodiment of the present invention.

In a further embodiment, the system is used to adapt to a new attribute such as a new emotion. This will be described with reference to FIG. 16.

As in FIG. 15, first, a target voice is received in step S601, the data is collected for the voice speaking with the new attribute. First, the weightings for the neutral speaker clusters are adjusted to best match the target voice in step S603.

Then, a new emotion cluster is added to the existing emotion clusters for the new emotion in step S607. Next, the decision tree for the new cluster is initialised as described with relation to FIG. 12 from step S455 onwards. The weightings, model parameters and trees are then re-estimated and rebuilt for all clusters as described with reference to FIG. 11.

Any of the speaker voices which may be generated by the system can be output with the new emotion.

Figure 17:
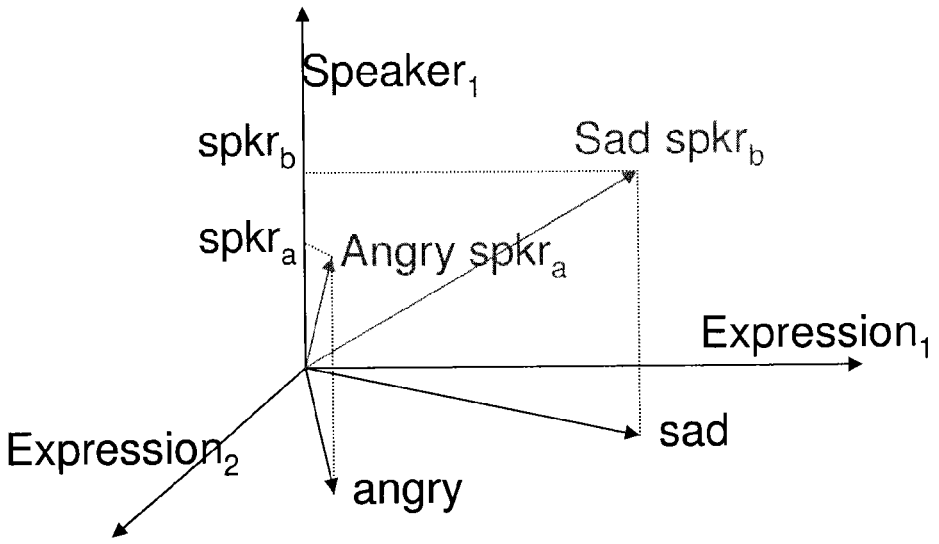
FIG. 17 is a plot showing how emotions can be transplanted between different speakers.

FIG. 17 shows a plot useful for visualising how the speaker voices and attributes are related. The plot of FIG. 17 is shown in 3 dimensions but can be extended to higher dimension orders.

Speakers are plotted along the z axis. In this simplified plot, the speaker weightings are defined as a single dimension, in practice, there are likely to be 2 or more speaker weightings represented on a corresponding number of axis.

Expression is represented on the x-y plane. With expression 1 along the x axis and expression 2 along the y axis, the weighting corresponding to angry and sad are shown. Using this arrangement it is possible to generate the weightings required for an "Angry" speaker a and a "Sad" speaker b. By deriving the point on the x-y plane which corresponds to a new emotion or attribute, it can be seen how a new emotion or attribute can be applied to the existing speakers.

Figure 18:
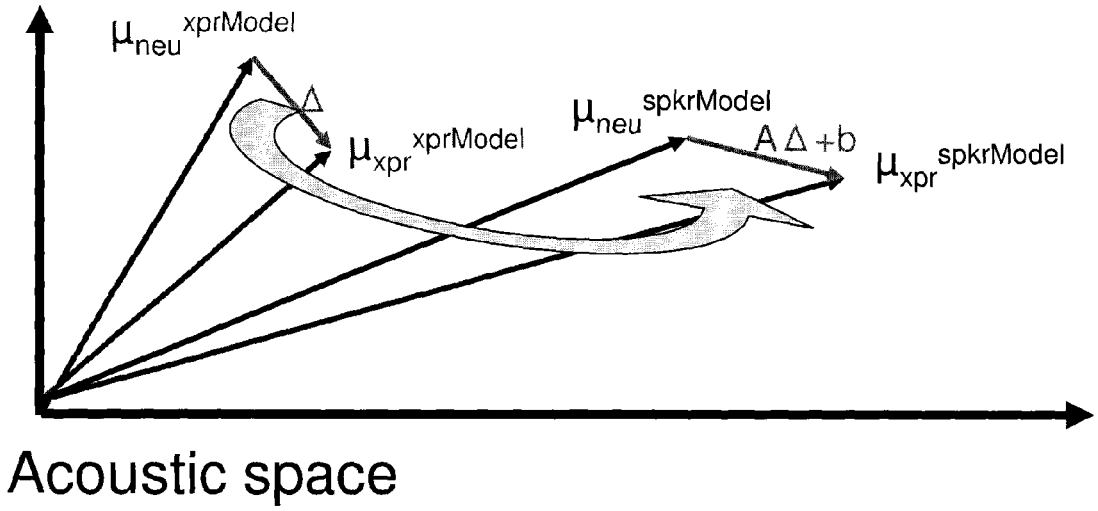
FIG. 18 is a plot of acoustic space showing the transplant of emotional speech.

FIG. 18 shows the principles explained above with reference to acoustic space. A 2-dimension acoustic space is shown here to allow a transform to be visualised. However, in practice, the acoustic space will extend in many dimensions.

In an expression CAT the mean vector for a given expression is $$\mu_{xpr} = \sum_{\forall k} \lambda_k^{xpr} \mu_k$$

Where $\mu_{xpr}$ is the mean vector representing a speaker speaking with expression xpr, $\lambda_k^{xpr}$ is the CAT weighting for component k for expression xpr and $\mu_k$ is the component k mean vector of component k.

The only part which is emotion-dependent are the weights. Therefore, the difference between two different expressions (xpr1 and xpr2) is just a shift of the mean vectors $$\mu_{xpr2} = \mu_{xpr1} + \Delta_{xpr1,xpr2}$$

$$\Delta_{xpr1,xpr2} = \sum_{\forall k} \left(\lambda_k^{xpr2} - \lambda_k^{xpr1}\right)\mu_k$$

This is shown in FIG. 18.

Thus, to port the characteristics of expression 2 (xpr2) to a different speaker voice (Spk2), it is sufficient to add the appropriate Δ to the mean vectors of the speaker model for Spk2. In this case, the appropriate Δ is derived from a speaker where data is available for this speaker speaking with xpr2. This speaker will be referred to as Spk1. Δ is derived from Spk1 as the difference between the mean vectors of Spk1 speaking with the desired expression xpr2 and the mean vectors of Spk1 speaking with an expression xpr. The expression xpr is an expression which is common to both speaker 1 and speaker 2. For example, xpr could be neutral expression if the data for neutral expression is available for both Spk1 and Spk2. However, it could be any expression which is matched or closely matched for both speakers. In an embodiment, to determine an expression which is closely matched for Spk1 and Spk2, a distance function can be constructed between Spk1 and Spk2 for the different expressions available for the speakers and the distance function may be minimised. The distance function may be selected from a euclidean distance, Bhattacharyya distance or Kullback-Leibler distance.

The appropriate Δ may then be added to the best matched mean vector for Spk2 as shown below:

$$\mu_{xpr2}^{Spk2} = \mu_{xpr1}^{Spk2} + \Delta_{xpr1,xpr2}$$

The above examples have mainly used a CAT based technique, but identifying a Δ can be applied, in principle, for any type of statistical model that allows different types of expression to be output.

While certain embodiments have been described, these embodiments have been presented by way of example only, and are not intended to limit the scope of the inventions. Indeed the novel methods and apparatus described herein may be embodied in a variety of other forms; furthermore, various omissions, substitutions and changes in the form of methods and apparatus described herein may be made without departing from the spirit of the inventions. The accompanying claims and their equivalents are intended to cover such forms of modifications as would fall within the scope and spirit of the inventions.

The invention claimed is:

1. A text-to-speech method configured to output speech having a selected speaker voice and a selected speaker attribute, said method comprising:

inputting text;

dividing said inputted text into a sequence of acoustic units;

selecting a speaker for the inputted text;

selecting a speaker attribute for the inputted text;

converting said sequence of acoustic units to a sequence of speech vectors using an acoustic model; and outputting said sequence of speech vectors as audio with said selected speaker voice and a selected speaker attribute, wherein said acoustic model comprises a first set of parameters relating to speaker voice and a second set of parameters relating to speaker attributes, wherein the first and second set of parameters do not overlap such that each can be varied independently, wherein selecting a speaker voice comprises selecting parameters from the first set of parameters which give the speaker voice and selecting the speaker attribute comprises selecting the parameters from the second set which give the selected speaker attribute, and wherein the first set of parameters and the second set of parameters are provided in clusters.

2. A method according to claim 1, wherein there are a plurality of sets of parameters relating to different speaker attributes and the plurality of sets of parameters do not overlap.

3. A method according to claim 1, wherein the acoustic model comprises probability distribution functions which relate the acoustic units to the sequence of speech vectors and selection of the first and second set of parameters modifies the said probability distributions.

4. A method according to claim 3, wherein said second parameter set is related to an offset which is added to at least some of the parameters of the first set of parameters.

5. A method according to claim 3, wherein control of the speaker voice and attributes is achieved via a weighted sum of the means of the said probability distributions and selection of the first and second sets of parameters controls the weightings used.

6. A method according to claim 5, wherein each cluster comprises at least one sub-cluster, and a weighting is derived for each sub-cluster.

7. A method according to claim 1, wherein the sets of parameters are continuous such that the speaker voice is variable over a continuous range and the voice attribute is variable over a continuous range.

8. A method according to claim 1, wherein the values of the first and second sets of parameters are defined using audio, text, an external agent or any combination thereof.

9. A method according to claim 4, wherein the method is configured to transplant a speech attribute from a first speaker to a second speaker, by adding second parameters obtained from the speech of a first speaker to that of a second speaker.

10. A method according to claim 9, wherein the second parameters are obtained by:

receiving speech data from the first speaker speaking with the attribute to be transplanted;

identifying speech data for the first speaker which is closest to the speech data of the second speaker;

determining the difference between the speech data obtained from the first speaker speaking with the attribute to be transplanted and the speech data of the first speaker which is closest to the speech data of the second speaker; and determining the second parameters from the said difference.

11. A method according to claim 10, wherein the difference is determined between the means of the probability distributions which relate the acoustic units to the sequence of speech vectors.

12. A method according to claim 10, wherein the second parameters are determined as a function of the said difference and said function is a linear function.

13. A method according to claim 11, wherein the identifying speech data for the first speaker which is closest to the speech data of the second speaker comprises minimizing a distance function that depends on the probability distributions of the speech data of the first speaker and the speech data of the second speaker.

14. A method according to claim 13, wherein said distance function is a euclidean distance, Bhattacharyya distance or Kullback-Leibler distance.

15. A non-transitory computer readable carrier medium comprising computer readable code configured to cause a computer to perform the method of claim 1.

16. A method according to claim 1, wherein the speaker attribute is related to emotion.

17. A method of training an acoustic model for a text-to-speech system, wherein said acoustic model converts a sequence of acoustic units to a sequence of speech vectors, the method comprising:

receiving speech data from a plurality of speakers and a plurality of speakers speaking with different attributes;

isolating speech data from the received speech data which relates to speakers speaking with a common attribute;

training a first acoustic sub-model using the speech data received from a plurality of speakers speaking with a common attribute, said training comprising deriving a first set of parameters, wherein said first set of parameters are varied to allow the acoustic model to accommodate speech for the plurality of speakers;

training a second acoustic sub-model from the remaining speech, said training comprising identifying a plurality of attributes from said remaining speech and deriving a set of second parameters wherein said set of second parameters are varied to allow the acoustic model to accommodate speech for the plurality of attributes; and outputting an acoustic model by combining the first and second acoustic sub-models such that the combined acoustic model comprises a first set of parameters relating to speaker voice and a second set of parameters relating to speaker attributes, wherein the first and second set of parameters do not overlap, and wherein selecting a speaker voice comprises selecting parameters from the first set of parameters which give the speaker voice and selecting the speaker attribute comprises selecting the parameters from the second set which give the selected speaker attribute.

18. A method according to claim 17, wherein the acoustic model comprises probability distribution functions which relate the acoustic units to the sequence of speech vectors, and training the first acoustic sub-model comprises arranging the probability distributions into clusters, with each cluster comprises at least one sub-cluster, and wherein said first parameters are speaker dependent weights to be applied such there is one weight per sub-cluster, and training the second acoustic sub-model comprises arranging the probability distributions into clusters, with each cluster comprises at least one sub-cluster, and wherein said second parameters are attribute dependent weights to be applied such there is one weight per sub-cluster.

19. A method according to claim 18, wherein the received speech data containing a variety of each one of the considered voice attributes.

20. A method according to claim 18, wherein training the model comprises repeatedly re-estimating the parameters of the first acoustic sub-model while keeping part of the parameters of the second acoustic sub-model fixed and then re-estimating the parameters of the second acoustic sub-model while keeping part of the parameters of the first acoustic model fixed until a convergence criteria is met.

21. A method according to claim 17, wherein the different attributes are related to emotion.

22. A text-to-speech system for use for simulating speech having a selected speaker voice and a selected speaker attribute a plurality of different voice characteristics, said system comprising:

a text input for receiving inputted text;

a processor configured to:

divide said inputted text into a sequence of acoustic units;

allow selection of a speaker for the inputted text;

allow selection of a speaker attribute for the inputted text;

convert said sequence of acoustic units to a sequence of speech vectors using an acoustic model, wherein said model has a plurality of model parameters describing probability distributions which relate an acoustic unit to a speech vector; and output said sequence of speech vectors as audio with said selected speaker voice and a selected speaker attribute, wherein said acoustic model comprises a first set of parameters relating to speaker voice and a second set of parameters relating to speaker attributes, wherein the first and second set of parameters do not overlap such that each can be varied independently, wherein selecting a speaker voice comprises selecting parameters from the first set of parameters which give the speaker voice and selecting the speaker attribute comprises selecting the parameters from the second set which give the selected speaker attribute and wherein the first set of parameters and the second set of parameters are provided in clusters.

23. A method according to claim 22, wherein the speaker attribute is related to emotion.

* * * * *